US010983450B2

(12) United States Patent
Nomura et al.

(10) Patent No.: US 10,983,450 B2
(45) Date of Patent: Apr. 20, 2021

(54) TONER

(71) Applicant: CANON KABUSHIKI KAISHA, Tokyo (JP)

(72) Inventors: Shotaro Nomura, Suntou-gun (JP); Yasuhiro Hashimoto, Mishima (JP); Yojiro Hotta, Mishima (JP); Koji Nishikawa, Susono (JP); Takaaki Furui, Tokyo (JP); Yuujirou Nagashima, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/728,115

(22) Filed: Dec. 27, 2019

(65) Prior Publication Data

US 2020/0209769 A1 Jul. 2, 2020

(30) Foreign Application Priority Data

Dec. 28, 2018 (JP) ..... JP2018-247140

(51) Int. Cl.
*G03G 9/08* (2006.01)
*G03G 9/087* (2006.01)
*G03G 9/097* (2006.01)

(52) U.S. Cl.
CPC ..... *G03G 9/08711* (2013.01); *G03G 9/0819* (2013.01); *G03G 9/0823* (2013.01); *G03G 9/0827* (2013.01); *G03G 9/08704* (2013.01); *G03G 9/08755* (2013.01); *G03G 9/08773* (2013.01); *G03G 9/09725* (2013.01)

(58) Field of Classification Search
CPC ..... G03G 9/09725; G03G 9/09775
USPC ..... 430/108.3, 108.6
See application file for complete search history.

(56) References Cited

U.S. PATENT DOCUMENTS

| | | | |
|---|---|---|---|
| 5,601,913 | A | 2/1997 | Ohtani et al. |
| 6,586,147 | B2 | 7/2003 | Iida et al. |
| 6,751,424 | B2 | 6/2004 | Komatsu et al. |
| 6,808,852 | B2 | 10/2004 | Hotta et al. |
| 6,929,894 | B2 | 8/2005 | Sugahara et al. |
| 7,112,393 | B2 | 9/2006 | Komoto et al. |
| 7,115,349 | B2 | 10/2006 | Iida et al. |
| 7,147,980 | B2 | 12/2006 | Itakura et al. |
| 7,273,686 | B2 | 9/2007 | Onuma et al. |
| 7,288,354 | B2 | 10/2007 | Moribe et al. |
| 7,306,889 | B2 | 12/2007 | Okubo et al. |
| 7,351,509 | B2 | 4/2008 | Moribe et al. |
| 7,422,832 | B2 | 9/2008 | Ogawa et al. |
| 7,455,947 | B2 | 11/2008 | Ida et al. |
| 7,459,253 | B2 | 12/2008 | Abe et al. |
| 7,544,457 | B2 | 6/2009 | Hashimoto et al. |
| 7,582,401 | B2 | 9/2009 | Ogawa et al. |
| 7,629,100 | B2 | 12/2009 | Okamoto et al. |
| 7,745,089 | B2 | 6/2010 | Okubo et al. |
| 7,767,370 | B2 | 8/2010 | Ishigami et al. |
| 7,816,063 | B2 | 10/2010 | Hashimoto et al. |
| 7,906,262 | B2 | 3/2011 | Ishigami et al. |
| 8,053,156 | B2 | 11/2011 | Abe et al. |
| 8,142,972 | B2 | 3/2012 | Hotta et al. |
| 8,227,162 | B2 | 7/2012 | Sano et al. |
| 8,247,147 | B2 | 8/2012 | Abe et al. |
| 8,367,289 | B2 | 2/2013 | Isono et al. |
| 8,426,094 | B2 | 4/2013 | Magome et al. |
| 8,440,382 | B2 | 5/2013 | Isono et al. |
| 8,497,054 | B2 | 7/2013 | Sugiyama et al. |
| 8,614,044 | B2 | 12/2013 | Matsui et al. |
| 8,652,737 | B2 | 2/2014 | Handa et al. |
| 8,778,581 | B2 | 7/2014 | Nonaka et al. |
| 8,778,585 | B2 | 7/2014 | Matsui et al. |
| 8,883,389 | B2 | 11/2014 | Matsui et al. |
| 8,916,319 | B2 | 12/2014 | Ikeda et al. |
| 8,927,188 | B2 | 1/2015 | Naka et al. |
| 8,940,467 | B2 | 1/2015 | Hashimoto et al. |
| 9,040,216 | B2 | 5/2015 | Fukudome et al. |

(Continued)

FOREIGN PATENT DOCUMENTS

| | | |
|---|---|---|
| EP | 0 430 076 | 6/1991 |
| EP | 2 669 740 | 12/2013 |

(Continued)

OTHER PUBLICATIONS

U.S. Appl. No. 16/701,260, Koji Nishikawa, filed Dec. 3, 2019.
U.S. Appl. No. 16/701,292, Tetsuya Kinumatsu, filed Dec. 3, 2019.
U.S. Appl. No. 16/701,412, Kosuke Fukudome, filed Dec. 3, 2019.
U.S. Appl. No. 16/728,050, Tsuneyoshi Tominaga, filed Dec. 27, 2019.
U.S. Appl. No. 16/728,060, Kentaro Yamawaki, filed Dec. 27, 2019.
U.S. Appl. No. 16/728,082, Yasuhiro Hashimoto, filed Dec. 27, 2019.

(Continued)

*Primary Examiner* — Mark A Chapman

(74) *Attorney, Agent, or Firm* — Venable LLP

(57) ABSTRACT

A toner comprising: a toner particle containing a binder resin; and an external additive, wherein the external additive comprises an external additive A and B; the external additive A has a number-average primary particle diameter of 35 to 300 nm, a dielectric constant $\varepsilon_{ra}$ of not more than 3.50, and a shape factor SF-1 of not more than 114, and is an organosilicon polymer particle having a particular T3 unit structure; a proportion for an area of a peak originating from silicon having the T3 unit structure with reference to that of all silicon elements is 0.50 to 1.00; the external additive B has a number-average primary particle diameter of from 5 nm to 25 nm and a dielectric constant $\varepsilon_{rb}$ that satisfies formula (A): $0.50 \leq \varepsilon_{rb} - \varepsilon_{ra}$ (A); and a coverage ratio by the external additive B for the toner particle surface is 50% to 100%.

5 Claims, No Drawings

(56) References Cited

U.S. PATENT DOCUMENTS

| | | | |
|---|---|---|---|
| 9,046,800 | B2 | 6/2015 | Hotta et al. |
| 9,097,997 | B2 | 8/2015 | Nomura et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,217,943 | B2 | 11/2015 | Matsui et al. |
| 9,201,323 | B2 | 12/2015 | Nishikawa et al. |
| 9,213,250 | B2 | 12/2015 | Nomura et al. |
| 9,213,251 | B2 | 12/2015 | Ohmori et al. |
| 9,229,345 | B2 | 1/2016 | Ikeda et al. |
| 9,250,548 | B2 | 2/2016 | Nomura et al. |
| 9,261,804 | B2 | 2/2016 | Yamazaki et al. |
| 9,341,970 | B2 | 5/2016 | Yoshiba et al. |
| 9,423,714 | B2 | 8/2016 | Kenmoku et al. |
| 9,470,993 | B2 | 10/2016 | Nishikawa et al. |
| 9,575,425 | B2 | 2/2017 | Naka et al. |
| 9,588,450 | B2 | 3/2017 | Tsuda et al. |
| 9,606,462 | B2 | 3/2017 | Nomura et al. |
| 9,715,188 | B2 | 7/2017 | Terauchi et al. |
| 9,772,570 | B2 | 9/2017 | Tsuda et al. |
| 9,778,583 | B2 | 10/2017 | Terauchi et al. |
| 9,804,514 | B2 | 10/2017 | Suzumura et al. |
| 9,829,818 | B2 | 11/2017 | Yoshiba et al. |
| 9,841,692 | B2 | 12/2017 | Hasegawa et al. |
| 9,897,932 | B2 | 2/2018 | Hotta et al. |
| 9,964,874 | B2 | 5/2018 | Suzumura et al. |
| 9,971,263 | B2 | 5/2018 | Fukucome et al. |
| 10,012,919 | B2 | 7/2018 | Matsui et al. |
| 10,101,683 | B2 | 10/2018 | Nishikawa et al. |
| 10,156,800 | B2 | 12/2018 | Tsuda et al. |
| 10,197,934 | B2 | 2/2019 | Matsui et al. |
| 10,228,627 | B2 | 3/2019 | Nagashima et al. |
| 10,228,630 | B2 | 3/2019 | Mizuguchi et al. |
| 10,241,430 | B2 | 3/2019 | Kimura et al. |
| 10,289,016 | B2 | 5/2019 | Fukudome et al. |
| 10,295,920 | B2 | 5/2019 | Nishikawa et al. |
| 10,295,921 | B2 | 5/2019 | Ohmori et al. |
| 10,303,075 | B2 | 5/2019 | Tanaka et al. |
| 10,310,397 | B2 | 6/2019 | Sano et al. |
| 2004/0058258 | A1 | 3/2004 | Yoshino et al. |
| 2004/0137356 | A1 | 7/2004 | Tomita et al. |
| 2008/0226998 | A1 | 9/2008 | Ishii et al. |
| 2009/0117477 | A1 | 5/2009 | Magome et al. |
| 2009/0155706 | A1 | 6/2009 | Shu et al. |
| 2010/0248110 | A1 | 9/2010 | Taguchi et al. |
| 2014/0220488 | A1 | 8/2014 | Hosoya et al. |
| 2015/0125790 | A1 | 5/2015 | Hotta et al. |
| 2015/0220013 | A1 | 8/2015 | Nishikawa et al. |
| 2016/0161874 | A1 | 6/2016 | Yamazaki et al. |
| 2016/0187799 | A1 | 6/2016 | Hiroshi et al. |
| 2016/0299446 | A1 | 10/2016 | Kuroki et al. |
| 2016/0378003 | A1 | 12/2016 | Arimura et al. |
| 2017/0123333 | A1 | 5/2017 | Kuroki et al. |
| 2017/0219947 | A1 | 8/2017 | Omori et al. |
| 2017/0329246 | A1 | 11/2017 | Yamawaki et al. |
| 2018/0329323 | A1 | 11/2018 | Kimura et al. |
| 2018/0329324 | A1 | 11/2018 | Kamikura et al. |
| 2018/0329327 | A1 | 11/2018 | Yamawaki et al. |
| 2018/0329329 | A1 | 11/2018 | Nakamura et al. |
| 2019/0235402 | A1 | 8/2019 | Inoue et al. |
| 2020/0081361 | A1 | 3/2020 | Yoshiba et al. |

FOREIGN PATENT DOCUMENTS

| | | |
|---|---|---|
| EP | 2 818 932 | 12/2014 |
| EP | 2 853 945 | 4/2015 |
| EP | 2 860 585 | 4/2015 |
| EP | 3 095 805 | 11/2016 |
| EP | 3 480 661 | 5/2019 |
| JP | 2010-249995 | 11/2010 |
| JP | 2013-156614 | 8/2013 |
| WO | 2018/003749 | 1/2018 |

OTHER PUBLICATIONS

U.S. Appl. No. 16/728,101, Taiji Katsura, filed Dec. 27, 2019.
U.S. Appl. No. 16/728,122, Masamichi Sato, filed Dec. 27, 2019.
U.S. Appl. No. 16/728,151, Masatake Tanaka, filed Dec. 27, 2019.
U.S. Appl. No. 16/728,157, Shohei Kototani, filed Dec. 27, 2019.
U.S. Appl. No. 16/728,171, Takaaki Furui, filed Dec. 27, 2019.
U.S. Appl. No. 16/728,179, Koji Nishikawa, filed Dec. 27, 2019.

TONER

BACKGROUND OF THE INVENTION

Field of the Invention

The present invention relates to a toner used in, for example, electrophotographic methods, electrostatic recording methods, and magnetic recording methods.

Description of the Related Art

A higher image quality and longer life than ever before have been required of laser beam printers (LBPs) in recent years. Specifically, LBPs must be able to make more prints from a single cartridge and must be able to maintain a high image quality during long-term use.

As a consequence, the toner used must exhibit a high flowability and a high charging performance during lifetime.

Approaches based on external addition are effective as a means for improving the flowability and charging performance of toner. The following methods have heretofore been used in order to bring about maintenance of a high flowability and charging performance by toner during long-term use: (1) the addition of large amounts of small-diameter silica particles, and (2) the co-use of small-diameter silica particles and large-diameter silica particles.

A specific application example for (1) is described in Japanese Patent Application Publication No. 2013-156614. This toner can maintain a high durability and can maintain its developing performance to a certain degree even in the latter half of its lifetime.

A specific application example for (2) is described in Japanese Patent Application Publication No. 2010-249995. This construction seeks to achieve coexistence between a high charging performance and flowability brought about by small-diameter silica particles, and an embedding-inhibiting effect brought about by large-diameter silica particles.

SUMMARY OF THE INVENTION

However, with regard to the toner of Japanese Patent Application Publication No. 2013-156614, it has been found that various adverse effects are produced due to the electrostatic aggregation of the small-diameter silica particles that are added in large amounts.

Specifically, the problem arises that electrostatic aggregates of the small-diameter silica particles form at the toner particle surface and these electrostatic aggregates undergo detachment and cause the image quality to decline by attaching to and contaminating the surface of the photosensitive member and disturbing the electrostatic latent image.

It has also been found that when the small-diameter silica particles on the toner particle surface undergo electrostatic aggregation during long-term use, the coverage ratio declines and the toner flowability declines, and as a result, problems with the image are also produced due to poor control.

Poor control is a phenomenon in which the toner load on the toner carrying member cannot be satisfactorily regulated by the toner control member and the toner laid-on level on the toner carrying member then becomes larger than the desired level. This is a factor causing image defects such as development ghosting, in which the image density becomes denser than desired.

With regard to the toner of Japanese Patent Application Publication No. 2010-249995, the performance during long-term use is improved by the large-diameter silica particles. However, the following problem has also been found: in the latter half of the long-term use, the small-diameter silica particles are buried before the large-diameter silica particles, resulting in changes in the charging performance and flowability of the toner and also in changes in the image quality.

Thus, regardless of these approaches, substantial measures that improve the durability of the developing performance are required.

The present invention provides a toner that solves the problems indicated above.

Specifically, the present invention provides a toner that, even during use in long-term lifetime, exhibits a high developing performance without image defects and maintains a high image quality.

The present invention relates to a toner comprising:

a toner particle that contains a binder resin; and an external additive, wherein the external additive comprises an external additive A and an external additive B;

the external additive A has a number-average primary particle diameter of from 35 nm to 300 nm;

a dielectric constant $\varepsilon_{ra}$ of the external additive A measured at 10 Hz is not more than 3.50;

the external additive A has a shape factor SF-1 of not more than 114;

the external additive A is an organosilicon polymer particle containing an organosilicon polymer and the organosilicon polymer has a structure in which silicon atoms and oxygen atoms are alternately bonded to each other;

a portion of silicon atoms in the organosilicon polymer has a T3 unit structure represented by $R^aSiO_{3/2}$;

$R^a$ represents an alkyl group having 1 to 6 carbons or a phenyl group;

in $^{29}$Si-NMR measurement of the external additive A, a proportion for an area of a peak originating from silicon having the T3 unit structure with reference to a total area of peaks originating from all silicon elements contained in the external additive A is from 0.50 to 1.00;

the external additive B has a number-average primary particle diameter of from 5 nm to 25 nm;

a dielectric constant $\varepsilon_{rb}$ of the external additive B measured at 10 Hz satisfies formula (A) given below:

$$0.50 \leq \varepsilon_{rb} - \varepsilon_{ra} \quad \text{(A);}$$

and a coverage ratio of a surface of the toner particle by the external additive B is from 50% to 100%.

The present thus provides a toner that, even during use in long-term lifetime, exhibits a high developing performance without image defects and maintains a high image quality.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

The present invention relates to a toner comprising:

a toner particle that contains a binder resin; and an external additive, wherein the external additive comprises an external additive A and an external additive B;

the external additive A has a number-average primary particle diameter of from 35 nm to 300 nm;

a dielectric constant $\varepsilon_{ra}$ of the external additive A measured at 10 Hz is not more than 3.50;

the external additive A has a shape factor SF-1 of not more than 114;

the external additive A is an organosilicon polymer particle containing an organosilicon polymer and the organosilicon polymer has a structure in which silicon atoms and oxygen atoms are alternately bonded to each other;

a portion of silicon atoms in the organosilicon polymer has a T3 unit structure represented by $R^aSiO_{3/2}$;

$R^a$ represents an alkyl group having 1 to 6 carbons or a phenyl group;

in $^{29}$Si-NMR measurement of the external additive A, a proportion for an area of a peak originating from silicon having the T3 unit structure with reference to a total area of peaks originating from all silicon elements contained in the external additive A is from 0.50 to 1.00;

the external additive B has a number-average primary particle diameter of from 5 nm to 25 nm;

a dielectric constant $\varepsilon_{rb}$ of the external additive B measured at 10 Hz satisfies formula (A) given below:

$$0.50 \leq \varepsilon_{rb} - \varepsilon_{ra} \quad \text{(A)};$$

and a coverage of a surface of the toner particle ratio by the external additive B is from 50% to 100%.

According to investigations by the present inventors, the toner structure indicated above makes possible, during use in long-term lifetime, the exhibition of a high developing performance without image defects and the maintenance of a high image quality. A detailed described thereof is provided in the following.

As noted above, the addition of large amounts of small-diameter silica particles does make possible the maintenance to a certain degree of a high image quality even in long-term image output during lifetime. However, when aggregates are produced by electrostatic aggregation of the small-diameter silica particles and these aggregates undergo detachment, the resulting reduction in the coverage ratio causes various problems.

The combined use of small-diameter silica particles with large-diameter silica particles prevents burial of the small-diameter silica particles and enables maintenance of a high charging performance and high flowability over a longer term than previously possible; however, a selective burial of the small-diameter silica particles occurs in the latter part of long-term use, and property changes occur due to this. As a consequence, this has not risen to the level of a substantial measure.

The present inventors therefore conceived of a method in which, through the addition, to a system to which a small-diameter external additive has been added in large amounts, of a large-diameter external additive having a lower dielectric constant than the small-diameter external additive and being more resistant to electrostatic aggregation, the electrostatic aggregation of the small-diameter external additive and the burial that occurs with long-term use would be simultaneously prevented and a high image quality would be maintained even during long-term use.

The present inventors first considered the physical disintegration of the electrostatic aggregates of the small-diameter external additive that are formed on the toner particle surface during long-term use.

Specifically, the present inventors pursued the disintegration of the electrostatic aggregates of the small-diameter external additive through the addition of a high-circularity, large-diameter external additive. Due to its high sphericity and high circularity, this external additive would easily roll and move on the toner particle surface, and due to its large diameter, it would itself be resistant to aggregate formation.

The present inventors investigated the use of silica particles as the small-diameter external additive and the use of fumed silica particles having a diameter of around 100 nm as the high-circularity, large-diameter external additive. It was anticipated that, when this high-circularity, large-diameter silica particle moves on the toner particle surface accompanying toner flow brought about by stirring during development during long-term use, this high-circularity, large-diameter silica particle would physically break up the electrostatic aggregates produced from the small-diameter silica particles.

However, in the actual system, the satisfactory expression of the effects desired for this design proved to be elusive. This is because the high-circularity, large-diameter silica particles underwent electrostatic aggregation with the small-diameter silica particles and ended up forming aggregates.

The present inventors therefore focused on the mechanism of electrostatic aggregation by the small-diameter external additive, e.g., small-diameter silica particles.

The electrostatic aggregation of powder particles is generally thought to occur because particles having different charging characteristics respectively assume positive and negative charges and aggregation occurs through attraction based on Coulombic force. However, it is difficult to postulate that particles giving rise to a positive charge and particles giving rise to a negative charge are separately present in a small-diameter external additive, e.g., small-diameter silica particles, that is homogeneous and uniform in composition.

The present inventors therefore hypothesized that the electrostatic aggregation of the small-diameter external additive is due to an electrostatic interaction at a more microscopic level, and is not due to the presence of positively charged and negatively charged particles. Specifically, it was thought that the electrostatic aggregation is due to so-called van der Waals forces, i.e., electrostatic aggregative forces due to permanent dipoles and excitation dipoles at the molecular level.

In the case of high-circularity, large-diameter silica particles having the same composition as the small-diameter silica particles, it is thought that the van der Waals forces at the particle surface act the same as for the small-diameter silica particles, and that as a consequence, at the time of impact with an electrostatic aggregate of the small-diameter silica particles, entanglement occurs rather than the break up thereof and an aggregate ends up being formed.

The present inventors therefore considered the regulation of the electrical characteristics of the high-circularity, large-diameter external additive.

Specifically, the present inventors thought that if the degree of polarization of the permanent dipoles and excitation dipoles was less than that of the small-diameter external additive, the occurrence of electrostatic aggregation would also be impeded and as a consequence the formation of electrostatic aggregates between the large-diameter external additive and small-diameter external additive would be impeded.

The present inventors focused on the dielectric constant as an index for the electrical characteristics of the high-circularity, large-diameter external additive.

It is difficult to directly measure the van der Waals force due to the permanent dipoles and excitation dipoles of the molecules at the fine particle surface at the level of the external additive, but the dielectric constant, which indicates the ease of polarization of a molecule in an electric field, can be conveniently measured.

The toner undergoes the greatest stirring and rubbing during actual development in a durability test, and, since an electric field, e.g., the developing bias and so forth, is applied in the vicinity of the toner carrying member where the external additive on the toner particle surface undergoes motion, it was thought that the degree of polarization of a molecule in an electric field, i.e., the dielectric constant, would be appropriate as an index for electrostatic aggregation.

It is thought that the desired effect is exhibited and an enhanced image quality is achieved when the dielectric constant of the high-circularity, large-diameter external additive has a value smaller than the dielectric constant of the small-diameter external additive.

However, it was difficult, using just regulation of the dielectric constant of the high-circularity, large-diameter external additive, to maintain the break-up effect on the electrostatic aggregates of the small-diameter external additive during long-term use.

The high-circularity, large-diameter external additive moves by rolling across the toner particle surface under the effect of the physical impact when the toner particle comes into contact with another toner particle or with a member such as the wall of the cartridge container. However, when the toner has been continuously subjected to high physical impact, e.g., during printing in a long-term lifetime, even a large-diameter external additive becomes buried in and fixed to the toner particle surface and its ability to roll across the surface is then impaired.

This burial occurs because a large-diameter external additive particle constituted of, e.g., an inorganic oxide, is relatively harder than the surface of a toner particle constituted of a resin. While, e.g., hardening the toner particle surface, may be contemplated as a countermeasure here, the resulting negative effects on, e.g., the low-temperature fixability, prevent this from being a fundamental solution.

The present inventors therefore reasoned that, by imparting elasticity to the large-diameter external additive particle, burial of the external additive particle could be suppressed through a dispersion of the mechanical impact through elastic deformation of the external additive particle, and carried out investigations in this regard. It was discovered as a result that an organosilicon polymer particle having a particular T3 unit structure, because such an organosilicon polymer particle has a favorable dielectric constant value and maintains a suitable elasticity, is also effective for suppressing burial.

The present invention is specifically described in the following.

Attachability to the toner particle surface, as well as the break-up effect on the electrostatic aggregates of the small-diameter external additive, can be exhibited when the number-average primary particle diameter of the high-circularity, large-diameter external additive (external additive A in the following) is from 35 nm to 300 nm.

At less than 35 nm there is almost no physical difference from the small-diameter external additive, and as a result burial in the electrostatic aggregates ends up occurring and the break-up effect cannot be exhibited. At more than 300 nm, a stable attachment to the toner particle surface cannot be realized and detachment ends up occurring, resulting in, e.g., member contamination.

This number-average particle diameter is preferably from 40 nm to 250 nm and is more preferably from 45 nm to 200 nm.

When external additive A has a dielectric constant $\varepsilon_{ra}$ measured at 10 Hz of not more than 3.50, this acts to impede the external additive A from itself engaging in electrostatic aggregation in an electric field. When $\varepsilon_{ra}$ is larger than 3.50, the van der Waals force due to permanent dipoles and excitation dipoles in an electric field becomes excessively large and the external additive A ends up aggregating with itself and the desired break-up effect cannot be exhibited.

The dielectric constant $\varepsilon_{ra}$ is preferably not more than 3.35 and is more preferably not more than 3.20. While there is no particular limitation on the lower limit, it is preferably at least 1.35 and is more preferably at least 1.50. The dielectric constant $\varepsilon_{ra}$ can be controlled through, e.g., the atomic composition and molecular structure of the external additive.

When the shape factor SF-1 of the external additive A is not more than 114, during long-term development, the external additive A can roll on the toner particle surface and the break-up effect on the electrostatic aggregates can be exhibited.

The shape factor SF-1 is an index that shows the degree of roundness of a particle, and a value of 100 indicates a perfect circle. A larger numerical value indicates a greater departure from a circle and assumption of an irregular shape.

When SF-1 is larger than 114, the shape becomes distorted, which impedes rolling on the toner particle surface and thus impedes the appearance of the break-up effect on the electrostatic aggregates.

The shape factor SF-1 of the external additive A is preferably not more than 110 and is more preferably not more than 107. The lower limit, on the other hand, is not particularly limited, but is preferably equal to or greater than 100. SF-1 can be controlled by such methods as inducing the aggregation of a plurality of particles during production of the external additive particle and/or partially burying, in the surface of a parent particle, a particle having a smaller diameter than the parent particle.

The external additive A is an organosilicon polymer particle and has a structure in which silicon atoms and oxygen atoms are alternately bonded to each other, and a portion of the organosilicon polymer has a T3 unit structure represented by $R^aSiO_{3/2}$. $R^a$ represents an alkyl group having 1 to 6 (preferably 1 to 3 and more preferably 1 or 2) carbon atoms or a phenyl group.

In $^{29}$Si-NMR measurement of the external additive A, a proportion for an area of a peak originating from silicon having the T3 unit structure with reference to a total area of peaks originating from all silicon elements contained in the external additive A is from 0.50 to 1.00. When this range is obeyed, the external additive A can acquire a suitable elasticity while maintaining a favorable dielectric constant.

On the other hand, at below 0.50, the elastic modulus of the external additive A undergoes an excessive decline, resulting in the occurrence of problems such as the occurrence of plastic deformation and a unification deformation with the same external additive particle. The proportion for this peak area is preferably from 0.60 to 1.00.

A high flowability and a high charging performance can be satisfactorily imparted to the toner when the small-diameter silica particles (external additive B in the following) have a number-average primary particle diameter of from 5 nm to 25 nm, which is thus preferred. When this number-average particle diameter is less than 5 nm, burial of the external additive in the toner particle surface is accelerated, and in addition, due to the increase in the surface area, a tight electrostatic aggregation occurs.

When this number-average particle diameter is greater than 25 nm, the ability to coat the toner particle surface declines and it becomes necessary to add large amounts in order to exhibit functionality at the toner level. Doing this creates problems, e.g., an impairment of the low-temperature fixability.

This number-average particle diameter is preferably from 5.5 nm to 24.5 nm and is more preferably from 6.0 nm to 24.0 nm.

The ability of the external additive A to break up the electrostatic aggregates is facilitated when the dielectric constant $\varepsilon_{rb}$ measured at 10 Hz of the external additive B satisfies the following relational formula (A).

$$0.50 \leq \varepsilon_{rb} - \varepsilon_{ra} \quad \text{(A)}$$

When $\varepsilon_{rb}$ does not satisfy this relational formula, electrostatic aggregation is produced between the external additive B and the external additive A and the expression of the break-up effect is impaired. The following formula (A') is preferably satisfied.

$$0.55 \leq \varepsilon_{rb} - \varepsilon_{ra} \leq 10.00 \quad \text{(A')}$$

The dielectric constant $\varepsilon_{rb}$ can be controlled using, e.g., the atomic composition and molecular structure of the external additive.

A sufficiently high charging performance and high flowability can be imparted to the toner, even in a long-term image output, when the coverage ratio by the external additive B of the toner particle surface is from 50% to 100%, which is thus preferred. When the coverage ratio is less than 50%, the charging performance and flowability of the toner in the latter part of long-term use is then inadequate, causing a reduction in the image quality and a reduction in the image density.

This coverage ratio is preferably from 55% to 95% and is more preferably from 60% to 90%. This coverage ratio can be controlled through the amount of addition and particle diameter of the external additive particles and through adjustment of the stress during external addition of the external additive particles.

The dispersity evaluation index for external additive A is preferably from 0.50 to 2.00 and is more preferably from 0.60 to 1.80. When this range is obeyed, the degree of dispersion at the toner particle surface is favorable, which suppresses the occurrence of problems such as a reduction in toner charging due to a high coverage by external additive A, which has comparatively low charging characteristics. A lower dispersity evaluation index indicates a better dispersity. The dispersity evaluation index for external additive A can be controlled using the duration of treatment during external addition and regulation of the stress during external addition.

The dispersity evaluation index for external additive B is preferably not more than 0.40 and is more preferably from 0.01 to 0.35. When this range is obeyed, a uniformly high coverage of the toner particle surface can be obtained and a sufficiently high charging performance and high flowability can be imparted to the toner even in a long-term image output during lifetime. The dispersity evaluation index for external additive B can be controlled using the duration of treatment during external addition and regulation of the stress during external addition.

The fixing ratio Aa for the external additive A on the toner particle surface and the fixing ratio Ab for the external additive B on the toner particle surface preferably satisfy the following relational formula (B). When this formula is satisfied, suitable fixing ratios are then obtained and the occurrence of problems due to detachment is impeded. In addition, burial and fixation at the toner particle surface caused by an excessive adhesion can be prevented and the desired effects can then be satisfactorily exhibited. (B') is more preferably satisfied.

$$|Aa - Ab| \leq 50\% \quad \text{(B)}$$

$$5\% \leq |Aa - Ab| \leq 45\% \quad \text{(B')}$$

The fixing ratio Aa can be controlled using the duration of treatment, treatment temperature, and stress adjustment during external addition. The fixing ratio Ab can be controlled using the duration of treatment, treatment temperature, and stress adjustment during external addition.

The toner preferably additionally contains, as an external additive C, at least one selected from the group consisting of titanium oxide fine particles and strontium titanate fine particles, and the fixing ratio Ac of this external additive C is preferably at least 40%. From 41% to 70% is more preferred. The fixing ratio Ac can be controlled using the duration of treatment, treatment temperature, and stress adjustment during external addition.

Titanium oxide and strontium titanate are low-resistance materials and provide a suitable leakage effect for accumulated charge and, when adhered at the toner particle surface, can effectively prevent electrostatic aggregation.

The number-average primary particle diameter of external additive C is preferably from 25 nm to 500 nm and is more preferably from 30 nm to 400 nm.

The content of external additive C, per 100 mass parts of the toner particle, is preferably from 0.05 mass parts to 2.00 mass parts and more preferably from 0.10 mass parts to 1.50 mass parts.

The external additive A used in the present invention is specifically described in the following.

The external additive A is an organosilicon polymer particle. This organosilicon polymer particle contains an organosilicon polymer. The organosilicon polymer has a structure in which silicon atoms and oxygen atoms are alternatively bonded to each other. The organosilicon polymer particle preferably contains the organosilicon polymer of at least 90 mass % based on the organosilicon polymer particle.

There are no particular limitations on the method for producing the organosilicon polymer particles, and, for example, they can be obtained by the dropwise addition of a silane compound to water and the execution of hydrolysis and condensation reactions under catalysis, followed by filtration of the resulting suspension and drying. The particle diameter can be controlled using, for example, the type of catalyst, the blending ratio, the temperature at the start of the reaction, and the duration of dropwise addition.

With regard to the catalyst, hydrochloric acid, hydrofluoric acid, sulfuric acid, and nitric acid are examples of acid catalysts, and aqueous ammonia, sodium hydroxide, and potassium hydroxide are examples of basic catalysis, but there is no limitation to these.

A portion of silicon atoms in the organosilicon polymer has a T3 unit structure represented by $R^{\alpha}SiO_{3/2}$. This $R^{\alpha}$ represents an alkyl group having 1 to 6 (preferably 1 to 3 and more preferably 1 or 2) carbons or a phenyl group.

In $^{29}$Si-NMR measurement of the external additive A (organosilicon polymer particle), a proportion for an area of a peak originating from silicon having the T3 unit structure with reference to a total area of peaks originating from all silicon elements contained in the external additive A is from 0.50 to 1.00. When this range is obeyed, the organosilicon polymer particle can be provided with a favorable elasticity, and the effects of the present invention are readily obtained as a result.

The organosilicon polymer particles are preferably a condensation polymer of an organosilicon compound having the structure represented by the following formula (2).

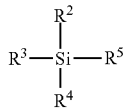

(2)

($R^2$, $R^3$, $R^4$, and $R^5$ in formula (2) each independently represent an alkyl group having 1 to 6 (preferably 1 to 3 and more preferably 1 or 2) carbons, a phenyl group, or a reactive group (for example, a halogen atom, hydroxy group, acetoxy group, or an alkoxy group (having preferably 1 to 6 carbons and more preferably 1 to 3 carbons)).)

An organosilicon compound having four reactive groups in each formula (2) molecule (tetrafunctional silane), an organosilicon compound having in formula (2) an alkyl group or phenyl group for $R^2$ and three reactive groups ($R^3$, $R^4$, $R^5$) (trifunctional silane), an organosilicon compound having in formula (2) an alkyl group or phenyl group for $R^2$ and $R^3$ and two reactive groups ($R^4$, $R^5$) (difunctional silane), and an organosilicon compound having in formula (2) an alkyl group or phenyl group for $R^2$, $R^3$, and $R^4$ and one reactive group ($R^5$) (monofunctional silane) can be used to obtain the organosilicon polymer particles used in the present invention. The use of at least 50 mol % trifunctional silane for the organosilicon compound is preferred in order to obtain 0.50 to 1.00 for the proportion for the area of the peak originating with the T3 unit structure.

The organosilicon polymer particle can be obtained by causing the reactive groups to undergo hydrolysis, addition polymerization, and condensation polymerization to form a crosslinked structure. The hydrolysis, addition polymerization, and condensation polymerization of $R^3$, $R^4$, and $R^5$ can be controlled using the reaction temperature, reaction time, reaction solvent, and pH.

The tetrafunctional silane can be exemplified by tetramethoxysilane, tetraethoxysilane, and tetraisocyanatosilane.

The trifunctional silane can be exemplified by methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, methyldiethoxyhydroxysilane, ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, hexyltrihydroxysilane, phenyltrimethoxysilane, phenyltriethoxysilane, phenyltrichlorosilane, phenyltriacetoxysilane, and phenyltrihydroxysilane.

The difunctional silane can be exemplified by di-tert-butyldichlorosilane, di-tert-butyldimethoxysilane, di-tert-butyldiethoxysilane, dibutyldichlorosilane, dibutyldimethoxysilane, dibutyldiethoxysilane, dichlorodecylmethylsilane, dimethoxydecylmethylsilane, diethoxydecylmethylsilane, dichlorodimethylsilane, dimethyldimethoxysilane, diethoxydimethylsilane, and diethyldimethoxysilane.

The monofunctional silane can be exemplified by t-butyldimethylchlorosilane, t-butyldimethylmethoxysilane, t-butyldimethylethoxysilane, t-butyldiphenylchlorosilane, t-butyldiphenylmethoxysilane, t-butyldiphenylethoxysilane, chlorodimethylphenylsilane, methoxydimethylphenylsilane, ethoxydimethylphenylsilane, chlorotrimethylsilane, trimethylmethoxysilane, ethoxytrimethylsilane, triethylmethoxysilane, triethylethoxysilane, tripropylmethoxysilane, tributylmethoxysilane, tripentylmethoxysilane, triphenylchlorosilane, triphenylmethoxysilane, and triphenylethoxysilane.

The external additive B is specifically described in the following. Any known material can be used without particular limitation for the external additive B as long as the relationship between the dielectric constant of the external additive B and the dielectric constant of the external additive A is in the prescribed range. External additive B is preferably silica particles.

The silica particles are a fine powder produced by the vapor-phase oxidation of a silicon halide compound, and are known as dry silica or fumed silica. For example, a pyrolytic oxidation reaction of silicon tetrachloride gas in an oxyhydrogen flame may be used, and this proceeds according to the following basic reaction equation.

$$SiCl_4+2H_2+O_2 \rightarrow SiO_2+4HCl$$

A composite particle of silica and another metal oxide can also be obtained in this production process by using the silicon halide compound in combination with another metal halide compound, e.g., aluminum chloride or titanium chloride, and the silica also encompasses these.

Examples of commercially available silica particles produced by the vapor-phase oxidation of a silicon halide compound are as follows: AEROSIL (Nippon Aerosil Co., Ltd.) 130, 200, 300, 380, TT600, MOX170, MOX80, and COK84; CAB-O-SIL (Cabot Corporation) M-5, MS-7, MS-75, HS-5, and EH-5; Wacker (Wacker-Chemie GmbH) HDK N 20, V15, N20E, T30, and T40; D-C Fine Silica (Dow Corning Corporation); and Fransol (Fransil Ltd.).

The silica particles are more preferably hydrophobically-treated silica particles. For Example, the hydrophobically-treated silica particles are provided by the execution of a hydrophobic treatment on silica particles that have been produced by the aforementioned vapor-phase oxidation of a silicon halide compound.

The specific surface area of the silica particles, by nitrogen adsorption measured by the BET method, is preferably from 30 $m^2/g$ to 300 $m^2/g$.

The content of external additive B, per 100 mass parts of the toner particle, is preferably from 0.25 mass parts to 5.00 mass parts and is more preferably from 0.30 mass parts to 4.50 mass parts.

The external additive B and/or C may be subjected to a surface treatment with the objective of providing it with hydrophobicity.

The hydrophobic treatment agent can be exemplified by chlorosilanes, e.g., methyltrichlorosilane, dimethyldichlorosilane, trimethylchlorosilane, phenyltrichlorosilane, diphenyldichlorosilane, t-butyldimethylchlorosilane, and vinyltrichlorosilane;

alkoxysilanes, e.g., tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, isobutyltrimethoxysilane, hexyltrimethoxysilane, octyltrimethoxysilane, decyltrimethoxysilane, dodecyltrimethoxysilane, tetraethoxysilane, methyltriethoxysilane, dimethyldiethoxysilane, phenyltriethoxysilane, diphenyldiethoxysilane, isobutyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl)aminopropyltrimethoxysilane, and γ-(2-aminoethyl) aminopropylmethyldimethoxysilane;

silazanes, e.g., hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, and dimethyltetravinyldisilazane;

silicone oils, e.g., dimethylsilicone oil, methylhydrogensilicone oil, methylphenylsilicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oil, fluorine-modified silicone oil, and terminal-reactive silicone oil;

siloxanes, e.g., hexamethylcyclotrisiloxane, octamethylcyclotetrasiloxane, decamethylcyclopentasiloxane, hexamethyldisiloxane, and octamethyltrisiloxane; and fatty acids and their metal salts, e.g., long-chain fatty acids such as undecylic acid, lauric acid, tridecylic acid, dodecylic acid, myristic acid, palmitic acid, pentadecylic acid, stearic acid, heptadecylic acid, arachidic acid, montanic acid, oleic acid, linoleic acid, and arachidonic acid, as well as salts of these fatty acids with metals such as zinc, iron, magnesium, aluminum, calcium, sodium, and potassium.

The use is preferred among the preceding of alkoxysilanes, silazanes, and silicone oils because they support facile execution of the hydrophobic treatment. A single one of these hydrophobic treatment agents may be used by itself or two or more may be used in combination.

The strontium titanate fine particles are specifically described in the following.

The strontium titanate fine particles are more preferably strontium titanate fine particles having a rectangular parallelepiped particle shape (also including the cubic shape) and having a perovskite crystal structure.

Such strontium titanate fine particles are mainly produced in an aqueous medium without going through a sintering step. As a consequence, control to a uniform particle diameter is readily exercised, and this is thus preferred. X-ray diffraction measurements can be used to confirm that the crystal structure of the strontium titanate fine particles is perovskite (face centered cubic lattice constituted of three different elements).

The strontium titanate fine particles have preferably been subjected to a surface treatment, based on a consideration of the development characteristics and from the standpoint of enabling control of the triboelectric charging characteristics and control of the environment-dependent triboelectric charge quantity.

The surface treatment agent can be exemplified by treatment agents such as fatty acids, metal salts of fatty acids, and organosilane compounds. The metal salts of fatty acids can be exemplified by zinc stearate, sodium stearate, calcium stearate, zinc laurate, aluminum stearate, and magnesium stearate, and the same effects are also obtained with stearic acid, a fatty acid.

The treatment method can be exemplified by a wet method in which treatment is carried out by dissolving or dispersing, e.g., the surface treatment agent for executing the treatment, in a solvent, adding the strontium titanate fine particles to this, and removing the solvent while stirring. An additional example is a dry method in which the coupling agent or fatty acid metal salt is directly mixed with the strontium titanate fine particles and treatment is carried out while stirring.

Methods for producing the toner particle are described in the following.

A known means can be used for the method for producing the toner particle, and a kneading pulverization method or a wet production method can be used. Wet production methods are preferably used from the standpoints of providing a uniform particle diameter and the ability to regulate the shape. Wet production methods can be exemplified by the suspension polymerization method, dissolution suspension method, emulsion polymerization and aggregation method, and emulsion aggregation method. The emulsion aggregation method can be preferably used for the present invention.

In the emulsion aggregation method, materials such as binder resin fine particles and as necessary fine particles of the other materials such as a colorant fine particles are first dispersed and mixed in an aqueous medium containing dispersion stabilizer. A surfactant may be added to the aqueous medium. This is followed by the addition of an aggregating agent to induce aggregation until the desired toner particle diameter is reached, and melt adhesion between the resin fine particles is carried out at the same time as or after aggregation. This is a method in which the toner particle is formed by optionally controlling the shape by heating.

Here, the binder resin fine particles may also be composite particles formed by a plurality of layers constituted of two or more layers composed of resins having different compositions. For example, production may be carried out by, for example, an emulsion polymerization method, a mini-emulsion polymerization method, or a phase inversion emulsification method, or production may be carried out by a combination of several production methods.

There is no particular limitation on the binder resin, and known resin can be used. Vinyl resins and polyester resins are preferred examples of the binder resin, and vinyl resins are more preferred. The following resins and polymers are examples of the vinyl resins and polyester resins as well as other binder resins:

homopolymers of styrene or a substituted form thereof, e.g., polystyrene and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; as well as polymethyl methacrylate, polybutyl methacrylate, polyvinyl acetate, polyethylene, polypropylene, polyvinyl butyral, silicone resins, polyamide resins, epoxy resins, polyacrylic resins, rosin, modified rosin, terpene resins, phenolic resins, aliphatic hydrocarbon resins, alicyclic hydrocarbon resins, and aromatic petroleum resins. A single one of these binder resins may be used by itself or a mixture of two or more may be used.

The following monomers, for example, can be used for the vinyl resin:

styrene monomers such as styrene and derivatives thereof, e.g., styrene, o-methylstyrene, m-methyl styrene, p-methyl styrene, p-methoxystyrene, p-phenyl styrene, p-chlorostyrene, 3,4-dichlorostyrene, p-ethyl styrene, 2,4-dimethyl styrene, p-n-butylstyrene, p-tert-butyl styrene, p-n-hexyl styrene, p-n-octylstyrene, p-n-nonylstyrene, p-n-decylstyrene, and p-n-dodecylstyrene;

acrylate esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and methacrylate esters, e.g., α-methylene aliphatic monocarboxylate esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate. Among these, a polymer of styrene with at least one selected from the group consisting of acrylate esters and methacrylate esters is preferred.

When an internal additive is incorporated in the toner particle, the internal additive may be contained in the resin fine particles, or a separate dispersion of internal additive fine particles composed of only the internal additive may be prepared and these internal additive fine particles may be aggregated in combination with aggregation of the resin fine particles. In addition, a toner particle constituted of layers having different compositions may also be produced by carrying out aggregation with the addition at different times during aggregation of resin fine particles having different compositions.

The following can be used as the dispersion stabilizer. Inorganic dispersion stabilizers can be exemplified by tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Organic dispersion stabilizers can be exemplified by polyvinyl alcohol, gelatin, methyl cellulose, methyl hydroxypropyl cellulose, ethyl cellulose, the sodium salt of carboxymethyl cellulose, and starch.

A known cationic surfactant, anionic surfactant, or nonionic surfactant can be used as the surfactant.

The cationic surfactants can be specifically exemplified by dodecylammonium bromide, dodecyltrimethylammonium bromide, dodecylpyridinium chloride, dodecylpyridinium bromide, and hexadecyltrimethylammonium bromide.

The nonionic surfactants can be specifically exemplified by dodecyl polyoxyethylene ether, hexadecyl polyoxyethylene ether, nonylphenyl polyoxyethylene ether, lauryl polyoxyethylene ether, sorbitan monooleate polyoxyethylene ether, styrylphenyl polyoxyethylene ether, and monodecanoyl sucrose.

The anionic surfactants can be specifically exemplified by aliphatic soaps such as sodium stearate and sodium laurate, as well as by sodium lauryl sulfate, sodium dodecylbenzenesulfonate, and sodium polyoxyethylene(2) lauryl ether sulfate.

The methods for measuring the properties pertaining to the present invention are described in the following.

Method for Measuring Number-Average Primary Particle Diameter of External Additive A Measurement of the number-average primary particle diameter of the external additive A is performed using an "S-4800" scanning electron microscope (product name, Hitachi, Ltd.). Observation is carried out on the toner to which external additive A have been added; in a visual field enlarged by a maximum of 50,000×, the long diameter of the primary particles of 100 randomly selected external additive A is measured; and the number-average particle diameter is determined. The enlargement factor in the observation is adjusted as appropriate depending on the size of the external additive A.

When the external additive A can be independently acquired as such, measurement can also be performed on these external additive A as such.

When the toner contains silicon-containing material other than the organosilicon polymer particles, EDS analysis is carried out on the individual particles of the external additive during observation of the toner and the determination is made, based on the presence/absence of a peak for the element Si, as to whether the analyzed particles are organosilicon polymer particles.

When the toner contains both organosilicon polymer particles and silica fine particles, the organosilicon polymer particles are identified by comparing the ratio (Si/O ratio) for the Si and O element contents (atomic %) with a standard. EDS analysis is carried out under the same conditions on standards for both the organosilicon polymer particles and silica fine particles to obtain the element content (atomic %) for both the Si and O. Using A for the Si/O ratio for the organosilicon polymer particles and B for the Si/O ratio for the silica fine particles, measurement conditions are selected whereby A is significantly larger than B. Specifically, the measurement is run ten times under the same conditions on the standards and the arithmetic mean value is obtained for both A and B. Measurement conditions are selected whereby the obtained average values satisfy $AB>1.1$.

When the Si/O ratio for a fine particle to be classified is on the A side from $[(A+B)/2]$, the fine particle is then scored as an organosilicon polymer particle.

Tospearl 120A (Momentive Performance Materials Japan LLC) is used as the standard for the organosilicon polymer particles, and HDK V15 (Asahi Kasei Corporation) is used as the standard for the silica fine particles.

Method for Measuring Number-Average Primary Particle Diameter of External Additive B Measurement of the number-average primary particle diameter of the external additive B is performed using an "S-4800" scanning electron microscope (product name, Hitachi, Ltd.). Observation is carried out on the toner to which the external additive B has been added; in a visual field enlarged by a maximum of 50,000×, the long diameter of the primary particles of 100 random selections of external additive B is measured; and the number-average particle diameter is determined. The enlargement factor in the observation is adjusted as appropriate depending on the size of the external additive B. When external additive B is a silica fine particle, discrimination from the organosilicon polymer can be performed using the aforementioned EDS analysis.

When the external additive B can be independently acquired as such, measurement can also be performed on this external additive B as such.

1 g of the toner is added to and dispersed in 31 g of chloroform in a vial. A dispersion is prepared by treatment for 30 minutes using an ultrasound homogenizer to effect dispersion. The treatment conditions are as follows. ultrasound treatment instrument: VP-050 ultrasound homogenizer (TIETECH Co., Ltd.) microtip: stepped microtip, 2 mmϕ end diameter position of microtip end: center of glass vial, 5 mm height from bottom of vial ultrasound conditions: 30% intensity, 30 minutes; during this treatment, the ultrasound is applied while cooling the vial with ice water to prevent the temperature of the dispersion from rising The dispersion is transferred to a glass tube (50 mL) for swing rotor service, and centrifugal separation is carried out using a centrifugal separator (H-9R, Kokusan Co., Ltd.) and conditions of 58.33 $S^{-1}$ for 30 minutes. Each of the materials constituting the toner is separated in the glass tube after centrifugal separation. Each of the materials is withdrawn and is dried under vacuum conditions (40° C./24 hours). The volume resistivity of each material is measured and the external additive B satisfying the conditions required in the present invention is then selected and the number-average primary particle diameter is measured.

Identification of External Additive A and Confirmation of T3 Unit Structure

The composition and ratios for the constituent compounds of the organosilicon polymer particles (external additive A) contained in the toner are identified using pyrolysis gas chromatography-mass analysis (also abbreviated in the following as "pyrolysis GC/MS") and NMR.

When the toner contains silicon-containing material other than the organosilicon polymer particles, the toner is dispersed in a solvent such as chloroform and the silicon-containing material other than the organosilicon polymer particles is then removed, for example, by centrifugal separation, based on the difference in specific gravity. This method is as follows.

1 g of the toner is first added to and dispersed in 31 g of chloroform in a vial and the silicon-containing material other than the organosilicon polymer particles is separated from the toner. To effect dispersion, a dispersion is prepared by treatment for 30 minutes using an ultrasound homogenizer. The treatment conditions are as follows.

ultrasound treatment instrument: VP-050 ultrasound homogenizer (TIETECH Co., Ltd.)
microchip: stepped microchip, 2 mmϕ end diameter
position of microchip end: center of glass vial, 5 mm height from bottom of vial
ultrasound conditions: 30% intensity, 30 minutes; during this treatment, the ultrasound is applied while cooling the vial with ice water to prevent the temperature of the dispersion from rising The dispersion is transferred to a glass tube (50 mL) for swing rotor service, and centrifugal separation is carried out using a centrifugal separator (H-9R, Kokusan Co., Ltd.) and conditions of 58.33 $S^{-1}$ for 30 minutes. The following are separated in the glass tube after centrifugal separation: the silicon-containing material other than the organosilicon polymer particles, and a sediment provided by the removal from the toner of the silicon-containing material other than the organosilicon polymer particles. The sediment provided by the removal from the toner of the silicon-containing material other than the organosilicon polymer particles is withdrawn and is dried under vacuum conditions (40° C./24 hours) to obtain a sample provided by the removal from the toner of the silicon-containing material other than the organosilicon polymer particles.

Using the sample obtained by the above or organosilicon polymer particles, the abundance of the constituent compounds of the organosilicon polymer particles and proportion for the T3 unit structure in the organosilicon polymer particles is then measured and calculated using solid-state $^{29}$Si-NMR.

Pyrolysis GC/MS is used for analysis of the species of constituent compounds of the organosilicon polymer particles.

The species of constituent compounds of the organosilicon polymer particles are identified by analysis of the mass spectrum of the pyrolyzate components derived from the organosilicon polymer particles and produced by pyrolysis of the toner at 550° C. to 700° C.

Measurement Conditions for Pyrolysis GC/MS
pyrolysis instrument: JPS-700 (Japan Analytical Industry Co., Ltd.)
pyrolysis temperature: 590° C.
GC/MS instrument: Focus GC/ISQ (Thermo Fisher)
column: HP-5MS, 60 m length, 0.25 mm inner diameter, 0.25 μm film thickness
injection port temperature: 200° C.
flow pressure: 100 kPa
split: 50 mL/min
MS ionization: EI
ion source temperature: 200° C., 45 to 650 mass range The abundance of the identified constituent compounds of the organosilicon polymer particles is then measured and calculated using solid-state $^{29}$Si-NMR.

In solid-state $^{29}$Si-NMR, peaks are detected in different shift regions depending on the structure of the functional groups bonded to the Si in the constituent compounds of the organosilicon polymer particles.

The structure of the functional groups of each peak can be identified by using a reference sample. The abundance of each constituent compound can be calculated from the obtained peak areas. The determination can be carried out by calculating the proportion for the peak area for the T3 unit structure with respect to total peak area.

The measurement conditions for the solid-state $^{29}$Si-NMR are as follows.

instrument: JNM-ECX5002 (JEOL RESONANCE)
temperature: room temperature
measurement method: DDMAS method, 29Si, 45°
sample tube: zirconia 3.2 mmϕ
sample: filled in powder form into the sample tube
sample rotation rate: 10 kHz
relaxation delay: 180 s
scans: 2,000

After this measurement, peak separation is performed, for the chloroform-insoluble matter of the organosilicon polymer particles, into the following structure X1, structure X2, structure X3, and structure X4 by curve fitting for silane components having different substituents and bonding groups, and their respective peak areas are calculated.

The structure X3 indicated below is the T3 unit structure in the present invention.

structure X1: $(Ri)(Rj(Rk)SiO_{1/2}$ (A1)

structure X2: $(Rg)(Rh)Si(O_{1/2})_2$ (A2)

structure X3: $RmSi(O_{1/2})_3$ (A3)

structure X4: $Si(O_{1/2})_4$ (A4)

(A1)

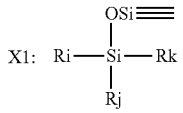

(A2)

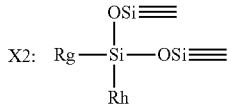

(A3)

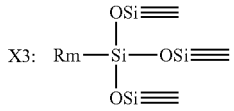

(A4)

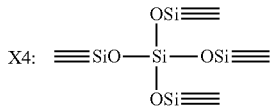

The Ri, Rj, Rk, Rg, Rh, and Rm in formulas (A1), (A2), and (A3) represent a silicon-bonded organic group, e.g., a hydrocarbon group having from 1 to 6 carbons, halogen atom, hydroxy group, acetoxy group, or alkoxy group.

The hydrocarbon group represented by the aforementioned $R^a$ is identified by $^{13}C$-NMR.

Measurement Conditions for $^{13}C$-NMR (Solid State)

instrument: JNM-ECX500II from JEOL RESONANCE, Inc.
sample tube: 3.2 mmϕ
sample: filled in powder form into the sample tube
measurement temperature: room temperature
pulse mode: CP/MAS
measurement nucleus frequency: 123.25 MHz ($^{13}C$)
reference material: adamantane (external reference: 29.5 ppm)
sample rotation rate: 20 kHz
contact time: 2 ms
retardation time: 2 s
number of integrations: 1024

In this method, the hydrocarbon group represented by $R^a$ is confirmed by the presence/absence of a signal originating with, e.g., the silicon atom-bonded methyl group ($Si—CH_3$), ethyl group ($Si—C_2H_5$), propyl group ($Si—C_3H_7$), butyl group ($Si—C_4H_9$), pentyl group ($Si—C_5H_{11}$), hexyl group ($Si—C_6H_{13}$), or phenyl group ($Si—C_6H_5$).

When a finer structural discrimination is necessary, identification may be carried out using the results of $^1H$-NMR measurement together with the results of the aforementioned $^{13}C$-NMR measurement and $^{29}Si$-NMR measurement.

Quantitation of External Additive A Contained in Toner

The content of the organosilicon polymer particles (external additive A) contained in the toner can be measured by the following method.

The x-ray fluorescence measurement is based on JIS K 0119-1969, and specifically is carried out as follows. An "Axios" wavelength-dispersive x-ray fluorescence analyzer (PANalytical B.V.) is used as the measurement instrument, and the "SuperQ ver. 5.0L" (PANalytical B.V.) software provided with the instrument is used in order to set the measurement conditions and analyze the measurement data. Rh is used for the x-ray tube anode; a vacuum is used for the measurement atmosphere; and the measurement diameter (collimator mask diameter) is 27 mm. With regard to the measurement, measurement is carried out using the Omnian method in the element range from F to U, and detection is carried out with a proportional counter (PC) in the case of measurement of the light elements and with a scintillation counter (SC) in the case of measurement of the heavy elements.

The acceleration voltage and current value for the x-ray generator are established so as to provide an output of 2.4 kW. For the measurement sample, 4 g of the toner is introduced into a specialized aluminum compaction ring and is smoothed over, and, using a "BRE-32" tablet compression molder (Maekawa Testing Machine Mfg. Co., Ltd.), a pellet is produced by molding to a thickness of 2 mm and a diameter of 39 mm by compression for 60 seconds at 20 MPa, and this pellet is used as the measurement sample.

X-ray exposure is carried out on the pellet molded under the aforementioned conditions, and the resulting characteristic x-rays (fluorescent x-rays) are dispersed with a dispersion element. The intensity of the fluorescent x-rays dispersed at the angle corresponding to the wavelength specific to each element contained in the sample is analyzed by the fundamental parameter method (FP method), the content ratio for each element contained in the toner is obtained as a result of the analysis, and the silicon atom content in the toner is determined.

The silicon mass ratio is then determined, for the constituent compound of the organosilicon polymer particles that has been structurally identified using, e.g., solid-state $^{29}Si$-NMR and pyrolysis GC/MS, from its molecular weight.

The content of the organosilicon polymer particles in the toner can be obtained by calculation from the relationship between the silicon content in the toner that is determined by x-ray fluorescence and the content ratio for the silicon in the constituent compounds of the organosilicon polymer particles for which the structure has been established using, e.g., solid-state $^{29}Si$-NMR and pyrolysis GC/MS.

When a silicon-containing material other than the organosilicon polymer particles is contained in the toner, using the same methods as described above, a sample provided by the removal from the toner of the silicon-containing material other than the organosilicon polymer particles, can be obtained and the organosilicon polymer particles contained in the toner can be quantitated.

Method for Measuring Dielectric Constant of External Additives

A power supply, an SI 1260 electrochemical interface (Toyo Corporation) serving as an ammeter, and a 1296 dielectric interface (Toyo Corporation) serving as an amplifier are used for measurement of the dielectric constant of the external additive particles.

The measurement specimen is a specimen prepared by hot molding a sample into a disk with a thickness of 3.0±0.5 mm using a tablet molder. Circular metal electrodes with a diameter of 10 mm are fabricated on the top and bottom sides of the specimen using masked vapor deposition.

The measurement electrodes are attached to the thusly prepared measurement specimen and an alternating voltage of 100 mVp-p at a frequency of 10 Hz is applied and the capacitance is measured. The dielectric constant ε of the measurement specimen is calculated using the following formula.

$$\varepsilon = dC/\varepsilon_0 S$$

d: thickness of the measurement specimen (m)
C: capacitance (F)
$\varepsilon_0$: dielectric constant of a vacuum (F/m)
S: electrode area ($m^2$)

Shape Factor SF-1 of External Additive A

The shape factor SF-1 of external additive A is calculated as follows using an "S-4800" scanning electron microscope (SEM) (product name, Hitachi, Ltd.) to observe toner to which the external additive has been externally added.

In a visual field enlarged by 100,000× to 200,000×, the area and peripheral length of the primary particles of 100 of the external additive A are calculated using "Image-Pro Plus 5.1J" (Media Cybernetics, Inc.) image processing software. Whether a particular external additive being observed is external additive A is discriminated using the method described in "Method for Measuring Number-average Primary Particle Diameter of External Additive A".

SF-1 is calculated using the following formula, and its average value is taken to be SF-1.

$$\text{SF-1} = (\text{largest length of the particle})^2/\text{particle area} \times \pi/4 \times 100$$

Coverage Ratio by External Additive B

The coverage ratio is determined by carrying out analysis with Image-Pro Plus ver. 5.0 image analysis software (Nippon Roper K. K.) on the toner surface image acquired with an S-4800 Hitachi Ultrahigh Resolution Field Emission Scanning Electron Microscope (Hitachi High-Technologies Corporation). The image acquisition conditions with the S-4800 are as follows.

(1) Specimen Preparation

An electroconductive paste is spread in a thin layer on the specimen stub (15 mm×6 mm aluminum specimen stub) and the toner is sprayed onto this. Blowing with air is additionally performed to remove excess toner from the specimen stub and carry out thorough drying. The specimen stub is set in the specimen holder and the specimen stub height is adjusted to 36 mm with the specimen height gauge.

(2) Setting Conditions for Observation with S-4800

The coverage ratio is determined using the image obtained by observation of the backscattered electron image with the S-4800. During analysis of the coverage ratio, elemental analysis is preliminarily carried out using the energy-dispersive x-ray analyzer (EDX), and the measurement is performed after excluding the particles other than the external additive B on the toner surface. When the external additive B is silica, the external additive B and the organosilicon polymer particles can be distinguished from each other through the combination of elemental analysis by EDS and the previously described observation of shape by SEM.

Liquid nitrogen is introduced to the brim of the anti-contamination trap attached to the S-4800 housing and standing for 30 minutes is carried out. The "PC-SEM" of the S-4800 is started and flashing is performed (the FE chip, which is the electron source, is cleaned). The acceleration voltage display area in the control panel on the screen is clicked and the [Flashing] button is pressed to open the flashing execution dialog. A flashing intensity of 2 is confirmed and execution is carried out. The emission current due to flashing is confirmed to be 20 to 40 μA. The specimen holder is inserted in the specimen chamber of the S-4800 housing. [Home] is pressed on the control panel to transfer the specimen holder to the observation position.

The acceleration voltage display area is clicked to open the HV setting dialog and the acceleration voltage is set to [1.1 kV] and the emission current is set to [20 μA]. In the [Base] tab of the operation panel, signal selection is set to [SE], [Upper (U)] and [+BSE] are selected for the SE detector, and the instrument is placed in backscattered electron image observation mode by selecting [L. A. 100] in the selection box to the right of [+BSE]. Similarly, in the [Base] tab of the operation panel, the probe current of the electron optical system condition block is set to [Normal]; the focus mode is set to [UHR]; and WD is set to [4.5 mm]. The [ON] button in the acceleration voltage display area of the control panel is pressed to apply the acceleration voltage.

(3) Focus Adjustment

Adjustment of the aperture alignment is carried out when some degree of focus has been obtained by turning the [COARSE] focus knob on the operation panel. [Align] in the control panel is clicked and the alignment dialog is displayed and [Beam] is selected. The displayed beam is migrated to the center of the concentric circles by turning the STIGMA/ALIGNMENT knobs (X, Y) on the operation panel. [Aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. The magnification is then set to 50,000× (50 k), focus adjustment is carried out as above using the focus knob and STIGMA/ALIGNMENT knobs, and focus is again performed with the autofocus. This operation is repeated again to achieve focus. Here, the accuracy of measurement of the coverage ratio readily declines when the plane of observation has a large angle of inclination, and for this reason simultaneous focus of the plane of observation as a whole is selected during focus adjustment and the analysis is carried out with selection of the smallest possible surface inclination.

(4) Image Storage

Brightness adjustment is performed using the ABC mode, and a photograph with a size of 640×480 pixels is taken and saved. Analysis is carried out as follows using this image file. One photograph is taken per one toner, and images are obtained for at least 25 or more toner particles.

(5) Image Analysis

The coverage ratio is determined in the present invention by carrying out binarization, using the analytic software described below, of the image yielded by the aforementioned procedure. Here, the single screen described above is partitioned into 12 squares and each is analyzed. The analysis conditions with the Image-Pro Plus ver. 5.0 image analysis software are as follows.

Image-Pro Plus 5.1J Software

"Count/Size" and then "Options" are selected from "Measure" in the toolbar and the binarization conditions are set. 8-Connect is selected in the object extraction option and smoothing is set to 0. In addition, pre-filter, hole filling, and enclosure line are not selected, and "Clean Borders" is set to "None". "Items of Measurements" is selected from "Measure" in the toolbar, and 2 to $10^7$ is input into Area of Filter Ranges.

The coverage ratio is calculated by outlining a square region. At this time, the area (C) of the region is made from 24,000 to 26,000 pixels. Automatic binarization is performed with "processing"-binarization, and the total (D) of the areas of the regions that are not external additive B (for example, silica) is calculated.

The coverage ratio is determined using the following formula from the area C of the square region and the total D of the areas of the regions that are not external additive B.

$$\text{coverage ratio (\%)}=100-(D/C\times 100)$$

The average value of all the obtained data is used as the coverage ratio.

The following procedure is used to separate the external additive from the toner particle when, in the aforementioned measurement methods, e.g., for the dielectric constant, the measurement sample is the external additive as separated from the toner particle surface.

1) For Nonmagnetic Toner 160 g of sucrose (Kishida Chemical Co., Ltd.) is added to 100 mL of deionized water and a sucrose concentrate is then prepared by dissolving while heating on a hot water bath. 31 g of this sucrose concentrate and 6 mL of Contaminon N are introduced into a centrifugal separation tube to prepare a dispersion. 1 g of the toner is added to this dispersion and the toner clumps are broken up with, e.g., a spatula.

Using the shaker referenced above, the centrifugal separation tube is shaken for 20 minutes under conditions of 350 oscillations per 1 minute. After shaking, the solution is transferred over to a glass tube (50 mL) for swing rotor service, and centrifugal separation is performed with a centrifugal separator (H-9R, Kokusan Co., Ltd.) and conditions of 58.33 $S^{-1}$ for 30 minutes. After centrifugal separation, the toner is present in the uppermost layer in the glass tube and the external additive is present in the aqueous solution side of the lower layer. The aqueous solution of the lower layer is recovered and subjected to centrifugal separation to separate the sucrose and external additive and the external additive is collected. Centrifugal separation is repeated as necessary to bring about a satisfactory separation, and this is followed by drying of the dispersion to collect the external additive.

When several types of external additives are present, the target external additive may be selected from the collected external additive using, for example, centrifugal separation.

Specifically, 1 g of the toner is added to and dispersed in 31 g of chloroform in a vial and a dispersion is prepared by treatment for 30 minutes using an ultrasound homogenizer to effect dispersion. The treatment conditions are as follows.

ultrasound treatment instrument: VP-050 ultrasound homogenizer (TIETECH Co., Ltd.)

microtip: stepped microtip, 2 mmϕ end diameter position of microtip end: center of glass vial, 5 mm height from bottom of vial ultrasound conditions: 30% intensity, 30 minutes; during this treatment, the ultrasound is applied while cooling the vial with ice water to prevent the temperature of the dispersion from rising The dispersion is transferred to a glass tube (50 mL) for swing rotor service, and centrifugal separation is carried out using a centrifugal separator (H-9R, Kokusan Co., Ltd.) and conditions of 58.33 $S^{-1}$ for 30 minutes. Each of the materials constituting the toner is separated in the glass tube after centrifugal separation. Each material is extracted and dried under vacuum conditions (40° C./24 hours). The volume resistivity of each of the materials is measured, and the external additives A and B satisfying the specifications required for the present invention are then selected.

2) For Magnetic Toner

A dispersion medium is first prepared by introducing 6 mL of Contaminon N (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.) into 100 mL of deionized water. 5 g of the toner is added to this dispersion medium and dispersion is carried out for 5 minutes using an ultrasound disperser (VS-150, AS ONE Corporation). This is followed by installation in a "KM Shaker" (model: V. SX) from Iwaki Sangyo Co., Ltd., and shaking is carried out for 20 minutes under conditions of 350 oscillations per 1 minute.

The supernatant is then recovered with the toner particles being retained using a neodymium magnet. The external additive is collected by drying this supernatant. This process is repeated when a sufficient amount of the external additive cannot be collected.

When several types of external additives are present, as in the case of nonmagnetic toner the target external additive is selected from the collected external additive using, for example, centrifugal separation.

Dispersity Evaluation Index of External Additives A and B at Toner Surface

The dispersity evaluation indexes for the external additives A and B at the toner surface are determined using an "S-4800" scanning electron microscope. In a visual field enlarged by 10,000×, observation at an acceleration voltage of 1.0 kV is performed in the same visual field of the toner to which external additive has been externally added. The determination is carried out, from the observed image, as described in the following using "ImageJ" image processing software.

Binarization is performed such that only external additive is extracted; the number n of the external additive and the barycentric coordinates for all the external additive are determined; and the distance do min to the nearest-neighbor external additive is determined for each external additive. The dispersity is given by the following formula using d ave for the average value of the nearest-neighbor distances between external additives in the image.

The dispersity is determined by the aforementioned procedure on 50 toner particles randomly selected for observation, and the average value thereof is used as the dispersity evaluation index.

$$\text{dispersity evaluation index} = \sqrt{\frac{\sum_{1}^{n}(dn\min - dave)^2}{n}} \Big/ dave$$

Discrimination of the external additives A and B in the toner is performed as in the method described in "Method for Measuring Number-average Primary Particle Diameter of External Additive A". During observation of the toner, EDS analysis is carried out on each external additive particle, and the determination is made as to whether an analyzed particle is external additive A and B from the presence/absence of Si element peaks.

When the toner contains an external additive C, EDS analysis is carried out on the individual external additive particles during observation of the toner, and the fine particles C are identified by comparing the ratio (Ti/O ratio) for the Ti and O element contents (atomic %), or the ratio (Sr/Ti/O ratio) for the Sr, Ti, and O element contents (atomic %), with a standard. The standard for titanium oxide is acquired from FUJIFILM Wako Pure Chemical Corporation (CAS No.: 1317-80-2), and the standard for strontium titanate is obtained from FUJIFILM Wako Pure Chemical Corporation (CAS No.: 12060-59-2).

Fixing Ratio of External Additives 20 g of "Contaminon N" (a 10 mass % aqueous solution of a neutral pH 7 detergent for cleaning precision measurement instrumentation, comprising a nonionic surfactant, anionic surfactant, and organic builder) is weighed into a 50-mL vial and mixing with 1 g of the toner is carried out.

This is set in a "KM Shaker" (model: V. SX) from Iwaki Sangyo Co., Ltd., and shaking is carried out for 30 seconds with the speed set to 50. This serves to transfer external additive from the toner particle surface into the dispersion, depending on the state of adhesion of the external additive.

Then, in the case of a nonmagnetic toner, the toner particles are separated, using a centrifugal separator (H-9R, Kokusan Co., Ltd.) (5 minutes at 16.67 $s^{-1}$), from the external additive that has transferred into the supernatant. In the case of a magnetic toner, the external additive that has transferred into the supernatant is separated with the toner particles being sequestered using a neodymium magnet, and the sedimented toner particles are dried to solidity by vacuum drying (40° C./24 hours) to obtain a sample.

A sample is made by converting the toner into a pellet by the press molding described below. An element characteristic of the external additive that is the analytic target is quantitated, using the wavelength-dispersive x-ray fluorescence analysis (XRF) described below, on the toner sample prior to the aforementioned treatment and after execution of the aforementioned treatment. The fixing ratio is determined using the formula given below from the amount of external additive that has not been transferred into the supernatant by the aforementioned treatment and has remained on the toner particle surface. The arithmetic average value of 100 samples is used.

(i) Example of Instrumentation Used 3080 x-ray fluorescence analyzer (Rigaku Corporation)

(ii) Sample Preparation

The sample is prepared using a sample press molder (Maekawa Testing Machine MFG. Co., LTD.). 0.5 g of the toner is introduced into an aluminum ring (model number: 3481E1); the load is set to 5.0 tons; and pressing is carried out for 1 minute to produce a pellet.

(iii) Measurement Conditions measurement diameter: 10ϕ
measurement potential, voltage: 50 kV, 50 to 70 mA
2θ angle: 25.12°
crystal plate: LiF
measurement time: 60 seconds

(iv) Method for Calculating Fixing Ratio of External Additives fixing ratio (%) of external additive=(intensity for element originating with external additive, for toner after treatment/intensity for element originating with external additive, for toner before treatment)×100 [Formula]

The discrimination of external additive C from external additives A and B is carried out by the determination of elements characteristic of the external additives using XRF measurement.

The discrimination of external additive A from external additive B is carried out using the particle diameter of each external additive in those instances where the execution of this discrimination by determination of elements characteristic of the external additives is problematic. Specifically, the supernatant recovered using the previously described centrifugal separation is measured using a DC24000 disc centrifugal particle size distribution analyzer from CPS Instruments, Inc. This results in a quantitation, by particle diameter, of the amounts of occurrence of the external additives in the supernatant, and the fixing ratio of an external additive on the toner particle surface is derived from the difference from the amount of the external additive present in the original toner particle.

The details of this procedure are given in the following.

A syringe needle for use with the CPS measurement instrument is placed on the end of an all-plastic disposable syringe (Tokyo Garasu Kikai Co., Ltd.) equipped with a syringe filter (diameter: 13 mm/pore diameter: 0.45 μm) (Advantec Toyo Kaisha, Ltd.), and 0.1 mL of the supernatant is collected.

The supernatant recovered with the syringe is injected into the DC24000 disc centrifugal particle size distribution analyzer and the amount of occurrence of external additive particles is measured by particle diameter.

The details of the measurement method are as follows.

First, the disc is rotated at 24,000 rpm using Motor Control in the CPS software. The following conditions are then set using Procedure Definitions.

(1) Sample Parameter

Maximum Diameter: 0.5 μm
Minimum Diameter: 0.05 μm

Particle Density: 2.0 to 2.2 g/mL (adjusted as appropriate depending on the sample)
Particle Refractive Index: 1.43
Particle Absorption: 0 K
Non-sphericity Factor: 1.1

(2) Calibration Standard Parameters

Peak Diameter: 0.226 μm
Half Height Peak Width: 0.1 μm
Particle Density: 1.389 g/mL
Fluid Density: 1.059 g/mL
Fluid Refractive Index: 1.369
Fluid Viscosity: 1.1 cps After these conditions have been set, a density gradient solution is prepared, using an AG300 Auto Gradient Builder from CPS Instruments, Inc. and using an 8 mass % aqueous sucrose solution and a 24 mass % aqueous sucrose solution, and 15 mL is injected into the measurement vessel.

After injection, an oil film is formed by the injection of 1.0 mL dodecane (Kishida Chemical Co., Ltd.) in order to prevent evaporation of the density gradient solution, and the instrument is held on standby for at least 30 minutes for stabilization.

After standby, standard particles for calibration (weight-based median particle diameter: 0.226 μm) are injected into the measurement instrument with a 0.1 mL syringe and calibration is performed. This is followed by injection into the instrument of the aforementioned collected supernatant and measurement of the amount of occurrence of the additive particles by particle diameter.

Specifically, quantitation is carried out from the areas of the peaks that occur for each particle diameter, by comparison with the area value of the calibration curve constructed by measurement with the external additive as such, and calculation of the percentage.

The present invention is described in greater detail in the following using examples and comparative examples, but the present invention is in no way limited to or by this. Unless specifically indicated otherwise, the number of parts in the examples and comparative examples is on a mass basis in all instances.

External Additive A1 Production Example

First Step 360.0 parts of water was introduced into a reaction vessel fitted with a thermometer and a stirrer, and 15.0 parts of hydrochloric acid having a concentration of 5.0 mass % was added to provide a uniform solution. While stirring this at a temperature of 25° C., 133.0 parts of methyltrimethoxysilane was added, stirring was performed for 5 hours, and filtration was carried out to obtain a transparent reaction solution containing a silanol compound or partial condensate thereof.

Second Step 540.0 parts of water was introduced into a reaction vessel fitted with a thermometer, stirrer, and dropwise addition apparatus, and 17.0 parts of aqueous ammonia having a concentration of 10.0 mass % was added to provide a uniform solution. While stirring this at a temperature of 35° C., 100 parts of the reaction solution obtained in the first step was added dropwise over 0.5 hour, and stirring was performed for 6 hours to obtain a suspension. The resulting suspension was processed with a centrifugal separator and the fine particles were sedimented and withdrawn and were dried for 24 hours with a dryer at a temperature of 200° C. to obtain external additive A1 comprising a polyalkylsilsesquioxane.

The obtained external additive A1 had a number-average particle diameter by observation with a scanning electron microscope of 100 nm and in $^{29}$Si-NMR measurement presented a peak for the T3 unit structure represented by $R^aSiO_{3/2}$. $R^a$ was the methyl group, and the proportion for an area of the peak originating from silicon having the T3 unit structure was 1.00. The properties of external additive A1 are given in Table 1.

TABLE 1

| | first step | | | | | | |
|---|---|---|---|---|---|---|---|
| external additive | water | hydrochloric acid | reaction temperature | silane compound A | | silane compound B | |
| No. | parts | parts | ° C. | name | parts | name | parts |
| A1 | 360 | 15.0 | 25 | methyltrimethoxysilane | 133.0 | — | — |
| A2 | 360 | 15.0 | 25 | methyltrimethoxysilane | 75.0 | tetramethoxysilane | 64.8 |
| A3 | 360 | 15.0 | 25 | methyltrimethoxysilane | 133.0 | — | — |
| A4 | 360 | 15.0 | 25 | methyltrimethoxysilane | 133.0 | — | — |
| A5 | 360 | 15.0 | 25 | methyltrimethoxysilane | 82.0 | tetramethoxysilane | 57.0 |
| A6 | 360 | 12.6 | 25 | methyltrimethoxysilane | 133.0 | — | — |
| A7 | 360 | 12.4 | 25 | methyltrimethoxysilane | 133.0 | — | — |
| A8 | 360 | 21.0 | 25 | methyltrimethoxysilane | 133.0 | — | — |
| A9 | 360 | 22.6 | 25 | methyltrimethoxysilane | 133.0 | — | — |
| A10 | — | — | — | — | — | — | — |
| A11 | 360 | 15.0 | 25 | methyltrimethoxysilane | 133.0 | — | — |
| A12 | 360 | 12.2 | 25 | methyltrimethoxysilane | 133.0 | — | — |
| A13 | 360 | 23.4 | 25 | methyltrimethoxysilane | 133.0 | — | — |
| A14 | 360 | 211.0 | 25 | methyltrimethoxysilane | 133.0 | — | — |
| A15 | 360 | 15.0 | 25 | methyltrimethoxysilane | 59.5 | tetramethoxysilane | 82.1 |

TABLE 1-continued

| external additive No. | second step reaction solution obtained in first step parts | water parts | aqueous ammonia parts | reaction start temperature ° C. | duration of dropwise addition h | number-average particle diameter [nm] | SF-1 | dielectric constant $\varepsilon_{ra}$ | proportion for area of T3 unit structure |
|---|---|---|---|---|---|---|---|---|---|
| A1 | 100 | 540 | 17.0 | 35 | 0.5 | 100 | 101 | 2.17 | 1.00 |
| A2 | 100 | 540 | 17.0 | 35 | 0.5 | 100 | 101 | 2.75 | 0.55 |
| A3 | 100 | 545 | 17.0 | 35 | 0.5 | 100 | 110 | 2.17 | 1.00 |
| A4 | 100 | 585 | 17.0 | 35 | 0.5 | 100 | 114 | 2.17 | 1.00 |
| A5 | 100 | 540 | 17.0 | 35 | 0.5 | 100 | 101 | 2.63 | 0.60 |
| A6 | 100 | 540 | 14.6 | 41.0 | 1.0 | 40 | 101 | 2.17 | 1.00 |
| A7 | 100 | 540 | 14.4 | 41.4 | 1.1 | 36 | 101 | 2.17 | 1.00 |
| A8 | 100 | 540 | 23.0 | 20.0 | 1.2 | 250 | 101 | 2.17 | 1.00 |
| A9 | 100 | 540 | 24.6 | 16.0 | 1.9 | 290 | 101 | 2.17 | 1.00 |
| A10 | — | — | — | — | — | 100 | 101 | 3.61 | 0 |
| A11 | 100 | 645 | 17.0 | 35 | 0.5 | 100 | 120 | 2.17 | 1.00 |
| A12 | 100 | 540 | 14.2 | 42.0 | 1.3 | 30 | 101 | 2.17 | 1.00 |
| A13 | 100 | 540 | 25.4 | 14.0 | 2.4 | 310 | 101 | 2.17 | 1.00 |
| A14 | 100 | 540 | 213.0 | 5.0 | 1652.3 | 5000 | 101 | 2.17 | 1.00 |
| A15 | 100 | 540 | 17.0 | 35 | 0.5 | 100 | 101 | 2.95 | 0.45 |

External Additives A2 to A9 Production Example

External additives A2 to A9 were obtained proceeding as in the External Additive A1 Production Example, but changing the silane compound, reaction start temperature, amount of catalyst addition, and duration of dropwise addition as indicated in Table 1. The properties are given in Table 1.

External Additive A10 Production Example

TGC-191 from Cabot Corporation was used as external additive A10. The properties of external additive A10 are given in Table 1.

External Additives A11 to A15 Production Example

External additives A11 to A15 were obtained proceeding as in the External Additive A1 Production Example, but changing the silane compound, reaction start temperature, amount of catalyst addition, and duration of dropwise addition as indicated in Table 1. The properties are given in Table 1.

External Additives B1 to B6

The particles indicated in Table 2 were used as external additives B1 to B6.

TABLE 2

| external additive No. | main component | particle diameter [nm] | dielectric constant $\varepsilon_{rb}$ |
|---|---|---|---|
| B1 | silica | 15 | 4.71 |
| B2 | silica | 30 | 4.71 |
| B3 | polymethylsilsesquioxane | 15 | 2.72 |
| B4 | polymethylsilsesquioxane | 15 | 2.68 |
| B5 | polymethylsilsesquioxane | 15 | 2.60 |
| B6 | silica/polymethylsilsesquioxane | 15 | 4.04 |

The particle diameter in the table is the number-average primary particle diameter.

The external additive particles for which silica was the main component were hydrophobed with 30 parts of hexamethyldisilazane (HMDS) and 10 parts of dimethylsilicone oil per 100 parts of the silica fine particles for each particle diameter.

The method for producing the external additive particles for which polymethylsilsesquioxane was the main component is as follows.

First, 336 parts of water and 3 parts of dodecylbenzenesulfonic acid as an acid catalyst were introduced into a reactor, and 45 parts of methyltrimethoxysilane, as a silanol-forming silicon compound, was added dropwise over 10 minutes while stirring and a hydrolysis reaction and condensation reaction were run at the same time. The temperature increase in the reaction system during dropwise addition was controlled to 20° C. to 25° C.

After the completion of dropwise addition of the methyltrimethoxysilane, stirring was continued while controlling the temperature of the reaction solution to 20° C. to 25° C. After 24 hours after the start of methyltrimethoxysilane dropwise addition, the catalyst was neutralized by the introduction of 7.4 parts of a 5% aqueous sodium hydroxide solution, thus finishing the hydrolysis reaction and condensation reaction and yielding an aqueous suspension. The obtained aqueous suspension was dried using a spray dryer to obtain polyorganosilsesquioxane fine particles. Adjustment was carried out in conformity to the desired dielectric constant by suitable mixing of tetramethoxysilane in the methyltrimethoxysilane for dropwise addition.

External Additives C1 and C2 Production Example

The particles indicated in Table 3 were used as external additives C1 and C2.

TABLE 3

| external additive No. | composition | particle diameter [nm] |
|---|---|---|
| C1 | titanium oxide | 20 |
| C2 | strontium titanate | 30 |

The particle diameter in the table is the number-average primary particle diameter.

Toner Particle 1 Production Example 89.5 parts of styrene, 9.2 parts of butyl acrylate, 1.3 parts of acrylic acid, and 3.2 parts of n-lauryl mercaptan were mixed and dissolved. To this solution was added an aqueous solution of 1.5 parts of Neogen RK (Dai-ichi Kogyo Seiyaku Co., Ltd.) dissolved in 150 parts of deionized water and dispersion was carried out. While slowly stirring for 10 minutes, an aqueous solution of 0.3 parts of potassium persulfate dissolved in 10 parts of deionized water was also added. After substitution with nitrogen, an emulsion polymerization was run for 6 hours at 70° C. After the completion of polymerization, the reaction solution was cooled to room temperature and deionized water was added to obtain a resin particle dispersion having a solids fraction concentration of 12.5 mass % and a median diameter of 0.2 μm on a volume basis.

Preparation of Release Agent Dispersion 100 parts of a release agent (behenyl behenate, melting point: 72.1° C.) and 15 parts of Neogen RK were mixed in 385 parts of deionized water and a release agent dispersion was obtained by dispersing for approximately 1 hour using a JN100 wet jet mill (JOKOH Co., Ltd.). The release agent dispersion had a concentration of 20 mass %.

Preparation of Colorant Dispersion 100 parts of "Nipex 35" (Orion Engineered Carbons LLC) as colorant and 15 parts of Neogen RK were mixed in 885 parts of deionized water and a colorant dispersion was obtained by dispersing for approximately 1 hour using a JN100 wet jet mill.

265 parts of the resin particle dispersion, 10 parts of the release agent dispersion, and 10 parts of the colorant dispersion were dispersed using a homogenizer (Ultra-Turrax T50, IKA). The temperature in the container was adjusted to 30° C. while stirring, and the pH was adjusted to 5.0 by the addition of 1 mol/L hydrochloric acid. After standing for 3 minutes, heating was begun and the temperature was raised to 50° C. and the production of aggregated particles was carried out. While in this state the particle diameter of the aggregated particles was measured with a "Coulter Counter Multisizer 3" (registered trademark, Beckman Coulter, Inc.). Once the weight-average particle diameter had reached 6.5 μm, a 1 mol/L aqueous sodium hydroxide solution was added to adjust the pH to 8.0 and stop particle growth.

After this, the temperature was raised to 95° C. and fusion and spheronizing of the aggregated particles was performed. When the average circularity had reached 0.980, cooling was begun and the temperature was lowered to 30° C. to obtain a toner particle dispersion 1.

Hydrochloric acid was added to the resulting toner particle dispersion 1 to adjust the pH to 1.5 or below and holding was carried out for 1 hour with stirring; this was followed by solid-liquid separation with a pressure filter to obtain a toner cake. This was reslurried in deionized water to remake a dispersion, followed by solid-liquid separation with the aforementioned filter. Reslurrying and solid-liquid separation were repeated until the conductivity of the filtrate reached 5.0 μS/cm or below, and a toner cake was yielded by the final solid-liquid separation.

The obtained toner cake was dried using a Flash Jet Dryer convection dryer (Seishin Enterprise Co., Ltd.). The drying conditions were an injection temperature of 90° C. and a dryer outlet temperature of 40° C., and the toner cake feed rate was adjusted in response to the water content of the toner cake to a rate at which the outlet temperature did not deviate from 40° C. The fines and coarse particles were cut using a Coanda effect-based multi-grade classifier to obtain a toner particle 1.

Toner 1 Production Example 100 parts of toner particle 1 and 1.0 parts of external additive A1 were introduced into a Henschel mixer (Model FM10C, Nippon Coke & Engineering Co., Ltd.) in which water at 7° C. was flowing in the jacket.

After the water temperature in the jacket had stabilized at 7° C.±1° C., mixing was carried out for 5 minutes at 49 m/sec for the peripheral velocity of the rotating blades. The amount of water flowing through the jacket was adjusted as appropriate during this time so the temperature in the tank of the Henschel mixer did not exceed 25° C.

0.2 parts of external additive C1 was then introduced into the Henschel mixer as a supplementary addition, and, after the water temperature in the jacket had stabilized at 7° C.±1° C., mixing was carried out for 3 minutes at 38 m/sec for the peripheral velocity of the rotating blades. The amount of water flowing through the jacket was adjusted as appropriate during this time so the temperature in the tank of the Henschel mixer did not exceed 25° C.

1.5 parts of external additive B1 was then introduced into the Henschel mixer as a supplementary addition, and, after the water temperature in the jacket had stabilized at 7° C.±1° C., mixing was carried out for 5 minutes at 38 m/sec for the peripheral velocity of the rotating blades to yield a toner mixture 1. The amount of water flowing through the jacket was adjusted as appropriate during this time so the temperature in the tank of the Henschel mixer did not exceed 25° C.

The obtained toner mixture 1 was sieved on a mesh having an aperture of 75 μm to obtain toner 1. The properties of toner 1 are given in Table 4.

TABLE 4

| toner No | ratio Aa | dispersity evaluation index for external additive A | fixing ratio Ab | dispersity evaluation index for external additive B | coverage ratio for external additive B [%] | $\varepsilon_{rb}$-$\varepsilon_{ra}$ | fixing ratio Ac | proportion for area for T3 unit structure |
|---|---|---|---|---|---|---|---|---|
| 1 | 34% | 1.21 | 52% | 0.30 | 62% | 2.54 | 41% | 1.00 |
| 2 | 34% | 1.21 | 52% | 0.30 | 62% | 2.54 | 41% | 0.55 |
| 3 | 34% | 1.21 | 52% | 0.30 | 70% | 2.54 | 41% | 0.55 |
| 4 | 34% | 1.21 | 52% | 0.30 | 62% | 2.54 | 40% | 1.00 |
| 5 | 34% | 1.21 | 52% | 0.30 | 62% | 2.54 | 40% | 1.00 |
| 6 | 34% | 1.21 | 52% | 0.30 | 62% | 2.54 | — | 1.00 |
| 7 | 25% | 1.21 | 70% | 0.30 | 62% | 2.54 | 35% | 1.00 |
| 8 | 20% | 1.21 | 70% | 0.30 | 62% | 2.54 | 35% | 1.00 |
| 9 | 15% | 1.21 | 70% | 0.30 | 62% | 2.54 | 35% | 1.00 |
| 10 | 15% | 1.21 | 70% | 0.35 | 62% | 2.54 | 35% | 1.00 |

TABLE 4-continued

| toner No | ratio Aa | dispersity evaluation index for external additive A | fixing ratio Ab | dispersity evaluation index for external additive B | coverage ratio for external additive B [%] | $\varepsilon_{rb}$-$\varepsilon_{ra}$ | fixing ratio Ac | proportion for area for T3 unit structure |
|---|---|---|---|---|---|---|---|---|
| 11 | 15% | 1.21 | 70% | 0.38 | 62% | 2.54 | 35% | 1.00 |
| 12 | 15% | 1.21 | 70% | 0.45 | 62% | 2.54 | 35% | 1.00 |
| 13 | 15% | 0.61 | 70% | 0.30 | 62% | 2.54 | 35% | 1.00 |
| 14 | 15% | 0.53 | 70% | 0.30 | 62% | 2.54 | 35% | 1.00 |
| 15 | 15% | 0.45 | 70% | 0.30 | 62% | 2.54 | 35% | 1.00 |
| 16 | 15% | 1.81 | 70% | 0.30 | 62% | 2.54 | 35% | 1.00 |
| 17 | 15% | 1.96 | 70% | 0.30 | 62% | 2.54 | 35% | 1.00 |
| 18 | 15% | 1.21 | 70% | 0.30 | 62% | 0.55 | 35% | 1.00 |
| 19 | 15% | 1.21 | 70% | 0.30 | 62% | 0.51 | 35% | 1.00 |
| 20 | 15% | 1.21 | 70% | 0.30 | 62% | 2.54 | 35% | 1.00 |
| 21 | 15% | 1.21 | 70% | 0.30 | 62% | 2.54 | 35% | 1.00 |
| 22 | 15% | 1.21 | 70% | 0.30 | 62% | 2.54 | 35% | 0.60 |
| 23 | 15% | 1.21 | 70% | 0.30 | 62% | 2.54 | 35% | 1.00 |
| 24 | 15% | 1.21 | 70% | 0.30 | 62% | 2.54 | 35% | 1.00 |
| 25 | 15% | 1.21 | 70% | 0.30 | 62% | 2.54 | 35% | 1.00 |
| 26 | 15% | 1.21 | 70% | 0.30 | 62% | 2.54 | 35% | 1.00 |
| 27 | 15% | 1.21 | 70% | 0.30 | 43% | 2.54 | 35% | 1.00 |
| 28 | 15% | 1.21 | 70% | 0.30 | 62% | 0.43 | 35% | 1.00 |
| 29 | 15% | 1.21 | 70% | 0.30 | 62% | 0.43 | 35% | 0.00 |
| 30 | 15% | 1.21 | 70% | 0.30 | 70% | 2.54 | 35% | 0.00 |
| 31 | 15% | 1.21 | 70% | 0.35 | 62% | 2.54 | 35% | 1.00 |
| 32 | 15% | 1.21 | 70% | 0.30 | 62% | 2.54 | 35% | 1.00 |
| 33 | 15% | 1.21 | 70% | 0.30 | 62% | 2.54 | 35% | 0.00 |
| 34 | 15% | 1.21 | 70% | 0.30 | 62% | 2.54 | 35% | 1.00 |
| 35 | 15% | 1.21 | 70% | 0.30 | 62% | 2.54 | 35% | 1.00 |
| 36 | — | — | 52% | 0.30 | 62% | — | 41% | — |
| 37 | 15% | 1.21 | 70% | 0.30 | 62% | 2.54 | 35% | 1.00 |
| 38 | 15% | 1.21 | 70% | 0.30 | 43% | 2.54 | 35% | 1.00 |
| 39 | 34% | 1.21 | 52% | 0.30 | 62% | 1.76 | 41% | 0.45 |

Toners 2 to 39 Production Example

Toners 2 to 39 were obtained proceeding as in the Toner 1 Production Example, but changing the external addition formulation and external addition conditions for the toner as shown in Table 5. The properties are given in Table 4. Toners 27 to 39 are toners for use in the comparative examples.

TABLE 5

| | first step | | | second step | | | third step | | |
|---|---|---|---|---|---|---|---|---|---|
| toner No. | mixing conditions | external additive No. | parts of addition | mixing conditions | external additive No. | parts of addition | mixing conditions | external additive No. | parts of addition |
| 1 | 49 m/sec • 5 minutes | A1 | 1.0 | 38 m/sec • 3 minutes | C1 | 0.2 | 38 m/sec • 5 minutes | B1 | 1.5 |
| 2 | 49 m/sec • 5 minutes | A2 | 1.0 | 38 m/sec • 3 minutes | C1 | 0.2 | 38 m/sec • 5 minutes | B1 | 1.5 |
| 3 | 49 m/sec • 5 minutes | A2 | 1.0 | 38 m/sec • 3 minutes | C1 | 0.2 | 38 m/sec • 5 minutes | B1 | 1.7 |
| 4 | 49 m/sec • 5 minutes | A1 | 1.0 | 37 m/sec • 3 minutes | C1 | 0.2 | 38 m/sec • 5 minutes | B1 | 1.5 |
| 5 | 49 m/sec • 5 minutes | A1 | 1.0 | 37 m/sec • 3 minutes | C2 | 0.2 | 38 m/sec • 5 minutes | B1 | 1.5 |
| 6 | 49 m/sec • 5 minutes | A1 | 1.0 | — | none | — | 38 m/sec • 5 minutes | B1 | 1.5 |
| 7 | 36 m/sec • 5 minutes | A1 | 1.0 | 33 m/sec • 3 minutes | C1 | 0.2 | 49 m/sec • 5 minutes | B1 | 1.5 |
| 8 | 30 m/sec • 5 minutes | A1 | 1.0 | 33 m/sec • 3 minutes | C1 | 0.2 | 49 m/sec • 5 minutes | B1 | 1.5 |
| 9 | 22 m/sec • 5 minutes | A1 | 1.0 | 33 m/sec • 3 minutes | C1 | 0.2 | 49 m/sec • 5 minutes | B1 | 1.5 |
| 10 | 22 m/sec • 5 minutes | A1 | 1.0 | 33 m/sec • 3 minutes | C1 | 0.2 | 49 m/sec • 6 minutes | B1 | 1.5 |
| 11 | 22 m/sec • 5 minutes | A1 | 1.0 | 33 m/sec • 3 minutes | C1 | 0.2 | 49 m/sec • 7 minutes | B1 | 1.5 |
| 12 | 22 m/sec • 5 minutes | A1 | 1.0 | 33 m/sec • 3 minutes | C1 | 0.2 | 49 m/sec • 9 minutes | B1 | 1.5 |
| 13 | 22 m/sec • 6 minutes | A1 | 1.0 | 33 m/sec • 3 minutes | C1 | 0.2 | 49 m/sec • 5 minutes | B1 | 1.5 |
| 14 | 22 m/sec • 9 minutes | A1 | 1.0 | 33 m/sec • 3 minutes | C1 | 0.2 | 49 m/sec • 5 minutes | B1 | 1.5 |
| 15 | 22 m/sec • 7 minutes | A1 | 1.0 | 33 m/sec • 3 minutes | C1 | 0.2 | 49 m/sec • 5 minutes | B1 | 1.5 |
| 16 | 22 m/sec • 12 minutes | A1 | 1.0 | 33 m/sec • 3 minutes | C1 | 0.2 | 49 m/sec • 5 minutes | B1 | 1.5 |
| 17 | 22 m/sec • 13 minutes | A1 | 1.0 | 33 m/sec • 3 minutes | C1 | 0.2 | 49 m/sec • 5 minutes | B1 | 1.5 |
| 18 | 22 m/sec • 5 minutes | A1 | 1.0 | 33 m/sec • 3 minutes | C1 | 0.2 | 49 m/sec • 5 minutes | B3 | 1.5 |
| 19 | 22 m/sec • 5 minutes | A1 | 1.0 | 33 m/sec • 3 minutes | C1 | 0.2 | 49 m/sec • 5 minutes | B4 | 1.5 |
| 20 | 22 m/sec • 5 minutes | A3 | 1.0 | 33 m/sec • 3 minutes | C1 | 0.2 | 49 m/sec • 5 minutes | B1 | 1.5 |
| 21 | 22 m/sec • 5 minutes | A4 | 1.0 | 33 m/sec • 3 minutes | C1 | 0.2 | 49 m/sec • 5 minutes | B1 | 1.5 |
| 22 | 22 m/sec • 5 minutes | A5 | 1.0 | 33 m/sec • 3 minutes | C1 | 0.2 | 49 m/sec • 5 minutes | B1 | 1.5 |
| 23 | 22 m/sec • 5 minutes | A6 | 1.0 | 33 m/sec • 3 minutes | C1 | 0.2 | 49 m/sec • 5 minutes | B1 | 1.5 |
| 24 | 22 m/sec • 5 minutes | A7 | 1.0 | 33 m/sec • 3 minutes | C1 | 0.2 | 49 m/sec • 5 minutes | B1 | 1.5 |

TABLE 5-continued

| | first step | | | second step | | | third step | | |
|---|---|---|---|---|---|---|---|---|---|
| toner No. | mixing conditions | external additive No. | parts of addition | mixing conditions | external additive No. | parts of addition | mixing conditions | external additive No. | parts of addition |
| 25 | 22 m/sec • 5 minutes | A8 | 1.0 | 33 m/sec • 3 minutes | C1 | 0.2 | 49 m/sec • 5 minutes | B1 | 1.5 |
| 26 | 22 m/sec • 5 minutes | A9 | 1.0 | 33 m/sec • 3 minutes | C1 | 0.2 | 49 m/sec • 5 minutes | B1 | 1.5 |
| 27 | 22 m/sec • 5 minutes | A1 | 1.0 | 33 m/sec • 3 minutes | C1 | 0.2 | 49 m/sec • 5 minutes | B1 | 1.3 |
| 28 | 22 m/sec • 5 minutes | A1 | 1.0 | 33 m/sec • 3 minutes | C1 | 0.2 | 49 m/sec • 5 minutes | B5 | 1.5 |
| 29 | 22 m/sec • 5 minutes | A10 | 1.0 | 33 m/sec • 3 minutes | C1 | 0.2 | 49 m/sec • 5 minutes | B6 | 1.5 |
| 30 | 22 m/sec • 5 minutes | A10 | 1.0 | 33 m/sec • 3 minutes | C1 | 0.2 | 49 m/sec • 5 minutes | B1 | 1.7 |
| 31 | 22 m/sec • 5 minutes | A1 | 1.0 | 33 m/sec • 3 minutes | C1 | 0.2 | 49 m/sec • 6 minutes | B2 | 1.5 |
| 32 | 22 m/sec • 5 minutes | A11 | 1.0 | 33 m/sec • 3 minutes | C1 | 0.2 | 49 m/sec • 5 minutes | B1 | 1.5 |
| 33 | 22 m/sec • 5 minutes | A10 | 1.0 | 33 m/sec • 3 minutes | C1 | 0.2 | 49 m/sec • 5 minutes | B1 | 1.5 |
| 34 | 22 m/sec • 5 minutes | A12 | 1.0 | 33 m/sec • 3 minutes | C1 | 0.2 | 49 m/sec • 5 minutes | B1 | 1.5 |
| 35 | 22 m/sec • 5 minutes | A13 | 1.0 | 33 m/sec • 3 minutes | C1 | 0.2 | 49 m/sec • 5 minutes | B1 | 1.5 |
| 36 | — | none | — | 38 m/sec • 3 minutes | C1 | 0.2 | 38 m/sec • 5 minutes | B1 | 1.5 |
| 37 | 22 m/sec • 5 minutes | A14 | 1.0 | 33 m/sec • 3 minutes | C1 | 0.2 | 49 m/sec • 5 minutes | B1 | 1.5 |
| 38 | 22 m/sec • 5 minutes | A1 | 1.0 | 33 m/sec • 3 minutes | C1 | 0.2 | 49 m/sec • 5 minutes | B1 | 1.0 |
| 39 | 49 m/sec • 5 minutes | A15 | 1.0 | 38 m/sec • 3 minutes | C1 | 0.2 | 38 m/sec • 5 minutes | B1 | 1.5 |

Example 1

The following evaluations were performed using an LBP652C laser beam printer from Canon, Inc. that had been modified to enable adjustment of the fixation temperature and process speed. In addition, the cartridge container capacity was enlarged and the amount of toner fill was increased and toner 1 was introduced.

Evaluation of Durability of Developing Performance

The evaluation of the durability of the developing performance was carried out after the main unit and the cartridge filled with toner 1 have been held for 24 hours in a high-temperature, high-humidity environment (temperature=32.5° C., humidity=80% RH).

The image density was measured by outputting a 5 mm-square solid black image and performing the measurement using an SPI filter with a MacBeth densitometer (MacBeth Corporation), which is a reflection densitometer. Under the conditions for the durability test wherein the image was outputted the by one-print intermittent mode of a 1.5% Bk print percentage, the image density at the start of the durability test, the image density after the output of 12,000 prints, and the image density after the output of 24,000 prints were compared and the corresponding percentage decline was calculated and was evaluated using the following criteria. A score of C or better was regarded as satisfactory.

A: The percentage decline in the image density is less than 3%.

B: The percentage decline in the image density is at least 3% but less than 5%.

C: The percentage decline in the image density is at least 5% but less than 7%.

D: The percentage decline in the image density is at least 7%.

The results of the evaluation are given in Table 6.

Evaluation of Fusion to Photosensitive Member (Fusion to Drum)

After the output of 12,000 prints and 24,000 prints in the aforementioned Evaluation of the Durability of the Developing Performance, the fusion of external additive aggregates to the surface of the photosensitive member was observed using a loupe. The evaluation criteria are given below. A score of C or better was regarded as satisfactory.

A: Fused material is entirely absent.

B: Fused material with a diameter of less than 0.10 mm is present on the surface of the photosensitive member.

C: Fused material having a diameter of at least 0.10 mm but less than 0.40 mm is present on the surface of the photosensitive member.

D: Fused material having a diameter of at least 0.40 mm is present on the surface of the photosensitive member.

The results of the evaluation are given in Table 6.

Development Ghosting Due to Poor Control

After the output of 12,000 prints and 24,000 prints in the aforementioned Evaluation of the Durability of the Developing Performance, a plurality of 10 mm×10 mm solid images were formed on the front half of the transfer paper and a 2 dot, 3 space halftone image was formed on the back half. The degree to which traces of the solid image could be detected in the halftone image was visually scored. A score of C or better was regarded as satisfactory.

A: Ghosting was not produced.

B: Very minor ghosting was produced.

C: Minor ghosting was produced.

D: Substantial ghosting was produced.

The results of the evaluation are given in Table 6.

TABLE 6

| | | at start of durability | after 12,000 prints in durability test | | | | after 24,000 prints in durability test | | | |
|---|---|---|---|---|---|---|---|---|---|---|
| Example No. | Toner No. | test image density | image density | percentage decline in image density | fusion to drum | development ghosting | image density | percentage decline in image density | fusion to drum | development ghosting |
| 1 | 1 | 1.51 | 1.48 | A (1.99%) | A | A | 1.47 | A (2.65%) | A | A |
| 2 | 2 | 1.50 | 1.47 | A (2.00%) | A | A | 1.46 | A (2.67%) | B | A |
| 3 | 3 | 1.52 | 1.49 | A (1.97%) | A | A | 1.48 | A (2.63%) | B | B |

TABLE 6-continued

| | | at start of durability | after 12,000 prints in durability test | | | | after 24,000 prints in durability test | | | |
|---|---|---|---|---|---|---|---|---|---|---|
| Example No. | Toner No. | test image density | image density | percentage decline in image density | fusion to drum | development ghosting | image density | percentage decline in image density | fusion to drum | development ghosting |
| 4 | 4 | 1.51 | 1.48 | A (1.99%) | A | A | 1.47 | A (2.65%) | B | A |
| 5 | 5 | 1.50 | 1.46 | A (2.67%) | A | A | 1.46 | A (2.67%) | B | A |
| 6 | 6 | 1.53 | 1.50 | A (1.96%) | B | A | 1.49 | A (2.61%) | C | A |
| 7 | 7 | 1.49 | 1.46 | A (2.01%) | A | A | 1.45 | A (2.68%) | B | B |
| 8 | 8 | 1.47 | 1.44 | A (2.04%) | A | A | 1.43 | A (2.72%) | B | B |
| 9 | 9 | 1.51 | 1.48 | A (1.99%) | B | A | 1.47 | A (2.65%) | B | B |
| 10 | 10 | 1.48 | 1.45 | A (2.03%) | B | A | 1.44 | A (2.70%) | B | B |
| 11 | 11 | 1.47 | 1.44 | A (2.04%) | B | A | 1.43 | A (2.72%) | B | B |
| 12 | 12 | 1.53 | 1.50 | A (1.96%) | B | B | 1.49 | A (2.61%) | B | B |
| 13 | 13 | 1.50 | 1.47 | A (2.00%) | B | A | 1.46 | A (2.67%) | B | B |
| 14 | 14 | 1.51 | 1.48 | A (1.99%) | B | A | 1.47 | A (2.65%) | B | B |
| 15 | 15 | 1.51 | 1.47 | A (2.65%) | B | A | 1.45 | B (3.97%) | B | B |
| 16 | 16 | 1.52 | 1.50 | A (1.32%) | B | A | 1.48 | A (2.63%) | B | B |
| 17 | 17 | 1.47 | 1.44 | A (2.04%) | B | A | 1.43 | A (2.72%) | B | B |
| 18 | 18 | 1.48 | 1.44 | A (2.70%) | B | B | 1.41 | B (4.73%) | C | B |
| 19 | 19 | 1.49 | 1.45 | A (2.68%) | C | B | 1.43 | B (4.03%) | C | C |
| 20 | 20 | 1.47 | 1.45 | A (1.36%) | B | A | 1.43 | A (2.72%) | B | B |
| 21 | 21 | 1.51 | 1.47 | A (2.65%) | B | B | 1.44 | B (4.64%) | B | B |
| 22 | 22 | 1.50 | 1.48 | A (1.33%) | B | B | 1.46 | A (2.67%) | C | B |
| 23 | 23 | 1.49 | 1.45 | A (2.68%) | B | B | 1.42 | B (4.70%) | C | B |
| 24 | 24 | 1.47 | 1.43 | A (2.72%) | C | B | 1.41 | B (4.08%) | C | C |
| 25 | 25 | 1.48 | 1.44 | A (2.70%) | B | B | 1.42 | B (4.05%) | B | C |
| 26 | 26 | 1.50 | 1.46 | A (2.67%) | B | C | 1.43 | B (4.67%) | B | C |
| C.E. 1 | 27 | 1.49 | 1.43 | B (4.03%) | C | B | 1.42 | B (4.70%) | C | D |
| C.E. 2 | 28 | 1.49 | 1.45 | A (2.68%) | C | B | 1.42 | B (4.70%) | D | C |
| C.E. 3 | 29 | 1.45 | 1.39 | B (4.14%) | C | B | 1.38 | B (4.83%) | D | C |
| C.E. 4 | 30 | 1.44 | 1.39 | B (3.47%) | C | B | 1.37 | B (4.86%) | D | C |
| C.E. 5 | 31 | 1.46 | 1.44 | A (1.37%) | B | C | 1.42 | A (2.74%) | B | D |
| C.E. 6 | 32 | 1.47 | 1.43 | A (2.72%) | C | B | 1.40 | B (4.76%) | D | C |
| C.E. 7 | 33 | 1.49 | 1.45 | A (2.68%) | C | B | 1.42 | B (4.70%) | D | C |
| C.E. 8 | 34 | 1.46 | 1.42 | A (2.74%) | C | B | 1.39 | B (4.79%) | D | C |
| C.E. 9 | 35 | 1.48 | 1.44 | A (2.70%) | C | B | 1.41 | B (4.73%) | D | C |
| C.E. 10 | 36 | 1.45 | 1.39 | B (4.14%) | D | C | 1.33 | D (8.28%) | D | D |
| C.E. 11 | 37 | 1.47 | 1.41 | B (4.08%) | D | C | 1.40 | B (4.76%) | D | D |
| C.E. 12 | 38 | 1.49 | 1.43 | B (4.03%) | C | C | 1.39 | C (6.71%) | C | D |
| C.E. 13 | 39 | 1.50 | 1.42 | C (5.33%) | B | B | 1.39 | D (7.33%) | C | D |

In the table, "C.E." denotes "Comparative Example".

Examples 2 to 26 and Comparative Examples 1 to 13

The same evaluations as in Example 1 were carried out, but changing the toner to toners 2 to 39. The results of the evaluations are given in Table 6.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-247140, filed Dec. 28, 2018, which is hereby incorporated by reference herein in its entirety.

What is claimed is:

1. A toner, comprising:

a toner particle that contains a binder resin; and an external additive comprising an external additive A and an external additive B;

external additive A being an organosilicon polymer particle containing an organosilicon polymer having a structure in which silicon atoms and oxygen atoms are alternately bonded to each other, external additive A having a number-average primary particle diameter of 35 to 300 nm, a dielectric constant $\varepsilon_{ra}$ of not more than 3.50 measured at 10 Hz, and a shape factor SF-1 of not more than 114;

external additive B having a number-average primary particle diameter of 5 to 25 nm, a dielectric constant $\varepsilon_{rb}$ satisfying $0.50 \leq \varepsilon_{rb} - \varepsilon_{ra}$, with a coverage ratio of a surface of the toner particle by external additive B being 50 to 100%, wherein a portion of silicon atoms in the organosilicon polymer has a T3 unit structure represented by $R^{a}SiO_{3:2}$ where $R^{a}$ represents an alkyl group having 1 to 6 carbons or a phenyl group, and a proportion for an area of a peak originating from silicon having the T3 unit structure with reference to a total area of peaks originating from all silicon elements contained in external additive A is 0.50 to 1.00 in $^{29}$Si-NMR measurement of the external additive A.

2. The toner according to claim 1, wherein external additive A has a dispersity evaluation index of 0.50 to 2.00 and external additive B has a dispersity evaluation index of not more than 0.40.

3. The toner according to claim 1, which satisfies $|Aa-Ab| \leq 50\%$ when Aa is a fixing ratio for external additive A on the surface of the toner particle and Ab is a fixing ratio for external additive B on the surface of the toner particle.

4. The toner according to claim 1, wherein the external additive comprises an external additive C containing at least one member selected from the group consisting of titanium oxide fine particles and strontium titanate line particles, and external additive C has a fixing ratio Ac of at least 40% on the toner particle surface.

5. The toner according to claim 1, wherein external additive B is a silica particle.

* * * * *